US008132572B2

(12) United States Patent
Kawabata et al.

(10) Patent No.: US 8,132,572 B2
(45) Date of Patent: Mar. 13, 2012

(54) PERMANENT WAVE TREATMENT METHOD AND APPARATUS THEREOF

(75) Inventors: Hideyuki Kawabata, Osaka (JP); Koji Okamoto, Osaka (JP); Takashi Hoshina, Osaka (JP); Ryuhei Nagata, Osaka (JP); Yasuaki Nakatani, Osaka (JP); Terumi Shibano, Osaka (JP); Tomoaki Takada, Osaka (JP); Ryouji Kitamura, Osaka (JP); Toshiki Yajima, Osaka (JP); Daisuke Mouri, Osaka (JP); Kazuya Yamanaka, Osaka (JP); Ichiro Yamamoto, Osaka (JP); Shinji Katsura, Osaka (JP)

(73) Assignee: Takara Belmont Corporation, Osaka (JP)

( * ) Notice: Subject to any disclaimer, the term of this patent is extended or adjusted under 35 U.S.C. 154(b) by 476 days.

(21) Appl. No.: 12/063,357

(22) PCT Filed: Jul. 25, 2007

(86) PCT No.: PCT/JP2007/065028

§ 371 (c)(1),
(2), (4) Date: Aug. 26, 2008

(87) PCT Pub. No.: WO2008/018330

PCT Pub. Date: Feb. 14, 2008

(65) Prior Publication Data

US 2010/0247469 A1 Sep. 30, 2010

(30) Foreign Application Priority Data

| | | |
|---|---|---|
| Aug. 8, 2006 | (JP) | 2006-215363 |
| Aug. 8, 2006 | (JP) | 2006-215364 |
| Aug. 8, 2006 | (JP) | 2006-215365 |
| Aug. 8, 2006 | (JP) | 2006-215366 |
| Sep. 11, 2006 | (JP) | 2006-246161 |
| Oct. 6, 2006 | (JP) | 2006-275811 |

(51) Int. Cl.
*A45D 6/06* (2006.01)

(52) U.S. Cl. ..... 132/228; 132/223; 34/96; 34/100

(58) Field of Classification Search ..... 132/269, 132/247, 261, 236–237, 220–223, 226–231, 132/233, 206, 207; 219/222; 34/4
See application file for complete search history.

(56) References Cited

U.S. PATENT DOCUMENTS 1,892,106 A * 12/1932 Jancke ..... 132/206

(Continued)

FOREIGN PATENT DOCUMENTS

EP 0497184 A1 8/1992

(Continued)

OTHER PUBLICATIONS

Air Neutralizing Perm. http://www.behindthechair.com/forum/displaythread.aspx?DID=6229. Accessed Dec. 2, 2009.*

(Continued)

*Primary Examiner* — Todd Manahan
*Assistant Examiner* — Brianne O'Neil
(74) *Attorney, Agent, or Firm* — Westerman, Hattori, Daniels & Adrian, LLP

(57) ABSTRACT

A permanent wave treatment apparatus comprises: a housing 3; a blower 1 which is installed within the housing to suck air and blow air; a steam separator 2 which is provided on the blower to remove water content from air sucked by suction force of the blower; an outlet hole formed in the housing through which air is spouted from the blower; hoods F mounted on the housing such that they are capable of being opened/closed freely; a plurality of rods R on which the hair of an object person is to be wound and in which air vent holes are formed; tubes 4 connected to the rods so as to keep the interior of the rods in a negative pressure by the suction force of the blower; and extraction member 5 which holds a plurality of the tubes such that they are capable of being extracted freely.

18 Claims, 31 Drawing Sheets

U.S. PATENT DOCUMENTS

| | | | | | |
|---|---|---|---|---|---|
| 2,314,101 | A | * | 3/1943 | Phipps | 34/77 |
| 3,313,037 | A | * | 4/1967 | Ullman | 34/99 |
| 3,444,624 | A | * | 5/1969 | Greenlee | 34/283 |
| 3,972,126 | A | * | 8/1976 | DeMuro et al. | 34/283 |
| 4,112,591 | A | * | 9/1978 | Marsh | 34/99 |
| 4,352,248 | A | * | 10/1982 | Kobayashi | 34/88 |

FOREIGN PATENT DOCUMENTS

| | | | | |
|---|---|---|---|---|
| JP | 1-104902 | | * | 7/1989 |
| JP | 1-104902 | A | | 7/1989 |
| JP | 1-104902 | U | | 7/1989 |
| JP | 04-503915 | A | | 7/1992 |
| JP | 4-503915 | A | | 7/1992 |
| JP | 2002-272529 | A | | 9/2002 |
| JP | 2004-262798 | A | | 9/2004 |
| JP | 2005-402 | A | | 1/2005 |
| JP | 2005-296351 | A | | 10/2005 |
| WO | 90/10399 | A1 | | 9/1990 |

OTHER PUBLICATIONS

Permanently Yours. http://permyour.com/?section=7. Archived by Google on Jan. 13, 2004. Accessed Jul. 28, 2010.*

International Preliminary Report on Patentability (Form PCT/IB/373) of International Application No. PCT/JP2007/0650280) issued Feb. 10, 2009 with Forms PCT/ISA/237.

International Search Report of PCT/JP2007/065028, date of mailing Aug. 28, 2007.

* cited by examiner

WET HAIR

DRY HAIR

HAIR DIRECTION CHANGED

PERMANENT WAVE TREATMENT METHOD AND APPARATUS THEREOF

TECHNICAL FIELD

The present invention relates to a permanent wave treatment apparatus for hair and more particularly to a permanent wave treatment apparatus capable of executing high safety treatment while protecting the hair from damage and maintaining finished wave in a long period.

BACKGROUND ART

Generally, the treatment for permanent wave is carried out in a following process. In that process, the hair is wound around a rod and a first permanent wave treatment agent containing reducing agent is applied to the hair. In this condition, the hair is left under the room temperature or heated to soften and swollen the hair and the reducing agent applied to the hair is washed out. Next, a second permanent wave treatment agent containing oxidizing agent is applied to fix the binding inside the hair by oxidizing and after that, the rods are removed and the second agent is washed out and then the hair is dried.

However, although this general permanent treatment method is an art which has prevailed generally, this has a disadvantage that the wave of the treated hair is expanded (becomes slack) when dried and its period of maintaining the wave is not sufficiently satisfactory.

Recently, a heating rod has been developed, this rod being heated directly by supplying current to the rod having a heater disclosed in Japanese Patent Application Laid-Open No. 2005-402 and a new permanent wave treatment method using this heating rod has been proposed. According to this new permanent wave treatment method, after the hair is softened and swollen by treatment with the first agent, the hair is wound around the heating rod and heated/dried. Consequently, waves that are less weaken (less slacken) than conventional ones when dried are formed. If an apparatus for drying the hair is applied for permanent wave treatment, use of a drier which has been used as an apparatus for setting the hair conventionally can be considered.

This apparatus includes art of drying the hair by making a rod in which air can be passed through, disclosed in Japanese Patent Application Laid-Open No. 2002-272529 blow hot air from inner peripheral face and outer peripheral face of the rod and an art in which part of the hair is wound around a hair winding cylinder having a rotatable slit and dried with the interior of the cylinder kept in a negative pressure while blowing hot air to a rotated cylinder as disclosed in Japanese Patent Application National Publication No. 4-503915.

Japanese Patent Application Laid-Open No. 2005-402

Japanese Patent Application Laid-Open No. 2002-272529

Japanese Patent Application National Publication No. 4-503915

DISCLOSURE OF THE INVENTION

The heating rod disclosed in the Japanese Patent Application Laid-Open No. 2005-402 can be heated to a high temperature (more than 100° C.) in order to dry the hair wound around the rod by several turns. If the hair is heated at such a high temperature, the hair can be damaged. Particularly, the tip of the hair which is often more damaged may be further damaged highly because it receives heat directly from the rod as the tip of the hair is wound inside around the rod. Further, another problem is that an object person feels heat on his or her head portion and discomfort because the heating rod is located near his or her head.

In the rod in which hot air is spouted from the inner peripheral face and outer peripheral face thereof as described in the Japanese Patent Application Laid-Open NO. 2002-27259, when the amount of water or chemical agent adhering to the hair is large, the water or chemical agent may be scattered around by hot air spouted from the inside of the rod to stain the object person's clothes; and there is another problem that a room is filled with smell of the chemical agent so that the object person and practitioner may feel discomfort.

Further, in case where part of the hair is wound around a rotatable hair winding cylinder having slits and the interior of the cylinder is kept in a negative pressure while blowing hot air and rotating the cylinder as described in the Japanese Patent Application National Publication No. 4-503915, it takes a quite a long time until the entire hair is dried because treatment to the hair may only be carried out for each turn of the hair.

The present invention intends to solve the above-described problems and an object of the invention is to provide a permanent wave treatment apparatus in which the hair is wound around a number of rods in heated environment while keeping the interior of the rods in a negative pressure so as to dry the hair wound around the plural rods all at once. The permanent wave treatment may thus be achieved in a short time and supply and suction of hot air can be carried out by a single blower thereby simplifying the structure thereof. Because the interior of the rod can be turned into a negative pressure only by inserting a tube to be connected to the rod into a suction pipe, each tube does not need to be connected to a suction means. Further, because extraction portions for the tubes are disposed on the right and left sides, the tubes are arranged neatly when connected to the rods, so that the tubes can be extracted easily and the tubes can be blocked from moving after extracted.

The permanent wave treatment method of the present invention intends to attain the above-described objects, and the means according to example 1 provides a permanent wave treatment method comprising: a first step of winding the hair around a rod; a second step of applying a first permanent wave treatment agent containing reducing agent to the wound hair so as to swell and soften the hair; a third step of washing out the first permanent wave treatment agent adhering to the swollen and softened hair or stopping the action of the first permanent wave treatment agent with acidic intermediate treatment agent for neutralizing the first permanent wave treatment agent or carrying out the both; a fourth step of leaving the wet hair after the third step for a predetermined amount of time while heating; and a fifth step of achieving disulfide binding by applying second permanent wave treatment agent containing oxidizing agent after the fourth step.

The means of example 2 provides the permanent wave treatment method according to example 1 wherein the temperature for heating the wet hair after the third step is 60° C. or less.

The means of example 3 provides the permanent wave treatment method according to example 1 wherein the wet hair after the third step is heated by hot air, steam or mist.

The means of example 4 provides the permanent wave treatment method according to example 1 wherein hot air, steam or mist is sucked with the interior of the rod around which the wet hair after the third step is wound kept in a low negative pressure.

The means of example 5 provides the permanent wave treatment method according to example 1 wherein sixth step of drying the hair with hot air at a temperature which does not damage the hair and applying second permanent wave treatment agent containing oxidizing agent to the dried hair to achieve disulfide binding thereby memorizing the shape in a dry condition is added after the fourth step.

The means of example 6 provides the permanent wave treatment method according to example 5 wherein the process of drying with hot air in the sixth step is a process of blowing hot air to the hair wound around the rod and sucking hot air by keeping the interior of the rod in a negative pressure.

The means of example 7 provides a permanent wave treatment apparatus comprising: a housing; a blower which is installed within the housing to suck air and blow air; a steam separator which is provided on the blower to remove water content from air sucked by suction force of the blower; an outlet hole formed in the housing through which air is spouted from the blower; hoods mounted on the housing such that they are capable of being opened/closed freely; a plurality of rods on which the hair of an object person is to be wound and in which air vent holes are formed; tubes connected to the rods so as to keep the interior of the rods in a negative pressure by the suction force of the blower; and an extraction member which holds a plurality of the tubes such that they are capable of being extracted freely.

The means of example 8 provides a permanent wave treatment apparatus comprising: a housing; a blower which is installed within the housing to suck air and blow air; a steam separator which is provided on the blower to remove water content from air sucked by suction force of the blower; an outlet hole formed in the housing through which air is spouted from the blower; hoods mounted on the housing such that they are capable of being opened/closed freely; a steam generating unit provided outside or inside the housing to supply steam into the hood; a plurality of rods on which the hair of an object person is to be wound and in which air vent holes are formed; tubes connected to the rods so as to keep the interior of the rods in a negative pressure by the suction force of the blower; and an extraction member which holds a plurality of the tubes such that they are capable of being extracted freely.

The means of example 9 provides the permanent wave treatment apparatus according to example 7 or 8 wherein air supplied by the blower is hot air heated by a heater.

The means of example 10 provides the permanent wave treatment apparatus according to example 9 wherein the heater is controlled by a temperature sensor provided in the hood.

The means of example 11 provides the permanent wave treatment apparatus according to example 1 or 2 wherein the extraction members are disposed on both sides of the outlet hole and constructed to be capable of locking an extracted condition of the tube.

The means of example 12 provides the permanent wave treatment apparatus according to example 7 or 8 wherein the steam separator includes a vortex generating unit installed on the bottom of the blower; a separating unit through which fluid contained in the air formed into a vortex by the vortex generating unit passes via slit; and a cup in which the fluid separated from the separating unit is collected.

The means of example 13 provides the permanent wave treatment apparatus according to example 7 or 8 wherein a portion of the tube opposite to a side connected to a rod is inserted into a suction pipe one end of which is connected to the vortex generating unit of the steam separator in air-tight condition while the other end is connected to the extraction member in air-tight condition and when the interior of the suction pipe turns into a negative pressure by the blower, the interior of the tube turns into a negative pressure.

The means of example 14 provides the permanent wave treatment apparatus according to example 8 wherein when steam is supplied into the hood by the steam generating unit, supply and suction of air are carried out by the blower.

The means of example 15 provides the permanent wave treatment apparatus according to example 7 or 8 wherein an outside air introducing unit which sucks outside air with a fan to introduce the outside air into the hood is provided within the housing.

The means of example 16 provides the permanent wave treatment apparatus according to example 15 wherein the opening portion for introducing air into the hood of the outside air introducing unit is open to the outlet hole which supplies hot air from the blower into the hood.

The means of example 17 provides the permanent wave treatment apparatus according to example 15 wherein the fan of the outside air introducing unit is driven when the temperature sensor detects that the temperature in the hood exceeds the predetermined temperature.

The means of example 18 provides the permanent wave treatment apparatus according to example 7 or 8 wherein the hood comprises a first hood for covering the rear head portion of the object person and a second hood for covering the forehead; and the respective hoods are supported by a shaft supporting member rotatably at a vertex portion thereof so that the respective supporting members are provided rotatably to the housing of the permanent wave treatment apparatus.

The means of example 19 provides the permanent wave treatment apparatus according to example 8 wherein one of the shaft supporting members which support the first hood and the second hood is a tightening member capable of being tightened and fixed at a desired angle in a relative angle between the first hood and the second hood.

The means of example 20 provides the permanent wave treatment apparatus according to example 18 wherein the other one of the shaft supporting members which supports the first hood and the second hood is a locking member which is locked when the second hood is located at a treatment angle position in order to prevent the second hood from rotating toward the face side of an object person.

The means of example 21 provides the permanent wave treatment apparatus according to example 18 wherein the shaft supporting member which supports the first hood and the second hood is provided detachably on the housing.

The means of example 22 provides the permanent wave treatment apparatus according to example 18 wherein in a treatment condition in which the amount of overlapping between the first hood and the second hood is reduced, area of object person's head from the forehead to the rear head is covered with covering cloth attached to an opening portion of the second hood so as to prevent hot air supplied from the permanent wave treatment apparatus from leaking out.

The means of example 23 provides the permanent wave treatment apparatus according to example 7 or 8 wherein the rod is constituted of a rod main body formed into a cylindrical shape in which a partition wall is formed inside while a plurality of air vent holes are formed in the outer peripheral face on a side whose length from the partition wall to an end thereof is larger; and a closing member which is attached detachably to an end portion of the rod main body on a side having the air vent holes and has an engaging portion which rotatably engages an engaging member connected to the suction means.

The means of example 24 provides the permanent wave treatment apparatus according to example 7 or 8 wherein the rod is constituted of a rod main body formed into a cylindrical shape in which a partition wall is formed inside while a plurality of air vent holes are formed in the outer peripheral face on a side whose length from the partition wall to an end thereof is larger; and a closing member which is attached detachably to an end portion of the rod main body on a side having the air vent holes, in which a lid portion is formed such that the thickness of a central portion inside is increased while the thickness of an outer peripheral portion is decreased so as to constitute a sump for fluid flowing from the air vent holes; an engaging portion which rotatably engages an engaging member connected to a suction means is open in the thick portion; and a communication hole which allows fluid from the sump to flow into the engaging portion is formed.

The means of example 25 provides permanent wave treatment apparatus according to example 23 or 24 wherein a portion of the engaging member which engages the closing member rotatably is formed as a ball portion; a portion of the closing member which engages the ball portion is formed as a circular engaging portion; and a cylindrical portion to which a suction tube is to be connected is formed integrally on an end portion opposite to the ball portion.

The means of example 26 provides the permanent wave treatment apparatus according to example 23 or 24 wherein a joint face between the rod main body and the closing member is formed in a concave/convex shape such as wave form so as to block the closing member from rotating with respect to the rod main body and prevent the hair from being caught by a joint portion.

The means of example 27 provides the permanent wave treatment apparatus according to example 23 or 24 wherein the closing member is colored in a different color from the rod main body so as to clarify the direction of the closing member so that a mounting direction of a matching member is seen easily.

The means of example 28 provides the permanent wave treatment apparatus according to example 23 or 24 wherein the closing member is constituted of a synthetic resin of at least flexible synthetic resin and a plurality of projecting portions are formed on an end face so that when the engaging member is fitted to the closing member in an oblique direction, the projecting portion is deformed so as to facilitate the fitting procedure.

The means of example 29 provides the permanent wave treatment apparatus according to example 22 or 24 wherein a small hole is formed in the outer peripheral face of the rod main body on a shorter side partitioned by the partition wall so as to prevent fluid like permanent wave treatment agent from being collected inside.

The means of example 30 provides a mode setting apparatus of permanent wave treatment apparatus in which treatment time and treatment temperature are determined based on one or more conditions regarding the amount of the hair of an object person, damage condition of the hair, and number of the rods on which the hair is to be wound for permanent wave treatment of winding the hair of the object person on the rods under heated environment in the hood and drying the hair wound on the rods by keeping the interior of the rod in a negative pressure and the permanent wave treatment is accelerated under the determined condition while the determined values are indicated on a display portion.

The means of example 31 provides a mode setting apparatus of permanent wave treatment apparatus wherein treatment time and treatment temperature are determined by inputting the amount of the hair of an object person, damage condition of the hair, and number of the rods on which the hair is to be wound by switches provided on a control panel for permanent wave treatment of winding the hair of the object person on the rods under heated environment in the hood and drying the hair wound on the rods by keeping the interior of the rod in a negative pressure and the permanent wave treatment is accelerated under the determined condition while the determined values are indicated on a display portion.

The means of example 32 provides the mode setting apparatus of permanent wave treatment apparatus according to example 30 or 31 wherein blower output is determined depending on the input condition and the permanent wave treatment is accelerated by the blower output and the condition indicated on the display portion.

The means of example 33 provides the mode setting apparatus of permanent wave treatment apparatus according to example 30 or 31 wherein the control panel includes switches disposed on the outer periphery of the control panel for inputting the conditions and is constituted of an indication portion which indicates conditions input by the switches disposed inside and an indication portion which indicates treatment time and treatment temperature determined according to the input conditions.

The means of example 34 provides the mode setting apparatus of permanent wave treatment apparatus according to example 30 or 31 wherein correction switches for changing the determined treatment time and treatment temperature are disposed on the control portion of the control panel.

According to the permanent wave treatment method, the hair is wound around a rod, a first permanent wave treatment agent containing reducing agent is applied to the wound hair so as to swell and soften the hair. After that, the first permanent wave treatment agent adhering to the swollen and softened hair is washed out or the action of the first permanent wave treatment agent is stopped with acidic intermediate treatment agent for neutralizing the first permanent wave treatment agent or both of them is carried out. The wet hair is left for a predetermined amount of time while heating and disulfide binding is achieved by applying a second permanent wave treatment agent containing oxidizing agent. Consequently, waves having a more excellent wave efficiency (nearer to the diameter of the rod) than the wave shape treated according to the conventional permanent wave treatment method are formed.

Because the temperature for heating the wet hair is set to 60° C. or less, no damage is applied to the hair. Because heating is carried out by steam or mist, the temperature of the hair can be raised efficiently with the hair maintained in wet condition and the amount of water can be controlled. Further, by sucking steam or mist by keeping the interior of the rod in a low negative pressure, the amount of water and temperature of the hair from its root to its tip can be equalized.

After the hair is left in the wet condition for a predetermined amount of time while heated, the hair is dried with hot air at a temperature which does not damage the hair and second permanent wave treatment agent containing oxidizing agent is applied to the dried hair to achieve disulfide binding, thereby memorizing the shape in a dry condition. Consequently, the slack of wave in a dry state is reduced much and the wave can be maintained in a long period. Further, because in the above drying process, hot air is blown to the hair wound around the rod and hot air is sucked by keeping the interior of the rod in a negative pressure, the drying time can be reduced thereby shortening the treatment time.

Example 7 to 13 of the permanent wave treatment apparatus of the present invention provides a structure for winding the hair of an object person around the rods having a plurality of air vent holes and connecting a tube to each rod in order to suck with a blower and at the same time, heat is applied around the object person's head in the hood in this condition. Consequently, the hair wound around the rods can be dried equally and quickly.

By heating the hair by supplying steam into the hood, the temperature of the hair can be raised while maintaining much water content in the hair (without drying the hair). Because the drying treatment is carried out after molecules move sufficiently into a shape deformed by the rod in conditions in which the molecules inside the hair can move easily, waves faithful to the rod diameter can be formed on finish stage as compared with a case in which no steam treatment is executed.

Further, drying of the hair can be achieved quickly by supplying hot air from the blower into the hood. Consequently, various treatments of the hair can be carried out in a short amount of time thereby improving the efficiency of services in beauty parlor.

Because the tubes are extracted from the extraction member disposed on the right and left sides, they can be disposed such that the tubes are not entangled when the hair is wound thereon and can be extracted easily because frictional resistance which occurs while the tube is extracted is reduced. Further, because the tube can be fixed by increasing the frictional resistance when the extraction is completed, the tubes can be prevented from being entangled with each other during the treatment.

Further, because the steam separator is disposed below the blower and fluid sucked by the blower is reformed into a vortex to separate liquid and fine hair or foreign matter such as dust adhering to the hair from air by the separator, liquid or foreign matter is blocked from flowing into the blower, thereby not affecting the blower badly.

Because the interior of the rod can be turned into a negative pressure only by inserting a tube to be connected to the rod into the suction pipe, each tube does not need to be connected to the suction means and therefore, the tube can be removed easily when cleaning the tube, thereby facilitating the washing of the tube.

Further, the hair can be heated with steam supplied into the hood so as to obtain high humidity and temperature when the first agent is applied to the hair. Steam is sucked slowly by keeping the interior of the rod in a negative pressure by operating only the blower with the heater turned OFF during generation of steam so that the chemical agent reacts with the hair wound around the rod sufficiently.

As regards example 14 to 17 of the present invention, when the temperature in the hood becomes higher than a preliminarily set temperature in a process of drying the hair by heating the hair with hot air supplied from the blower into the hood with the hair wound around the rod having a plurality of air vent holes while sucking with the blower with the tube connected to the rod, the fan of the outside air introducing unit is driven to take in outside air so as to hold a preliminarily set temperature. Consequently, permanent wave treatment can be carried out accurately and no discomfort is given to an object person.

The temperature of the hair can be raised with much water content held in the hair (without drying the hair) by heating the hair by supplying steam into the hood. Consequently, it comes that the drying procedure is carried out after molecules in the hair have moved into a shape deformed by the rods in a condition allowing those molecules to move easily. As a result, waves faithful to the rod diameter can be formed in finished state as compared with a case of not carrying out the steam treatment.

Because the opening of the outside air introducing unit is used as the outlet hole for supplying hot air from the blower into the hood, even if the outside air introducing unit is down, no hot air invades into the outside air introducing unit thereby hot air form the blower not affecting the fan of the outside air introducing unit badly.

Further, because the fan incorporated in the outside air introducing unit is controlled based on an output from a temperature sensor installed within the hood, when the temperature in the hood rises over a preliminarily set temperature due to some reason, it is driven so as to introduce outside air into the hood to reduce the temperature in the hood. Consequently, the permanent wave treatment can be carried out securely thereby no discomfort being supplied to the object person.

In the examples 18 to 22 of the present invention, the first hood for covering the rear head of the object person and the second hood for covering the forehead are mounted rotatably on the permanent wave treatment apparatus such that they are supported on the vertex portion of each hood rotatably by shaft supporting members. Thus, the hoods would never be obstacles to operations such as correction of a winding position of the rod and winding the hair around the rod.

Because one of the shaft supporting members which support the first hood and the second hood can be tightened and fixed at a desired angular position in terms of the relative angle between the first hood and the second hood, the procedure of winding the fringe around the rod or the like can be executed easily by moving the two hoods to the side of the face of the object person in an overlapped state.

Because the second hood can be locked at a treatment angular position with a locking member, the second hood can be prevented from rotating toward the object person's face, thereby the object person being protected from feeling discomfort due to rotation of the hoods in front of him or her during a treatment.

Because the shaft supporting member which supports the first hood and the second hood is installed removably to the permanent wave treatment apparatus, the treatment is facilitated by removing the hood when treating the hair of the forehead of the object person depending on a content of the treatment and cleaning of the hood can be carried out easily.

The entire head of the object person from the forehead to the rear head is covered with the covering cloth attached to the opening portion of the second hood depending on treatment condition so as to prevent hot air supplied from the permanent wave treatment apparatus from leaking out. Consequently, the object person is protected from feeling discomfort due to leakage of hot air or smell of permanent wave treatment agent from the hood and suction from the rod is carried out effectively thereby shortening the drying time.

In example 23 to 29 of the present invention, a number of the air vent holes are formed in the rod main body and an end side thereof is closed while the closing member having a circular joint portion is attached detachably to the other end while the ball portion is engaged with the joint portion rotatably. Consequently, the hair wound around the rod can be dried quickly by supplying hot air to the engaging member. When the rod main body is washed, it can be washed easily by removing the closing member from the rod main body.

The lid portion is formed such that the thickness of a central portion inside is increased while the thickness of an outer peripheral portion is decreased so as to constitute a sump for fluid flowing from the air vent holes and the circular engaging portion is formed in the thick portion and a communication hole which allows fluid from the sump to flow into the engaging portion is formed. Consequently, the rod having a large diameter can share an engaging member for the rod having a small diameter, so that permanent wave treatment can be done by preparing rods having different diameters thereby achieving reduction of cost.

With the suction tube connected to the engaging member and the hair wound around the rod main body, the hair is subjected to heated environment, while sucking hot air in the heated environment through the suction tube thereby achieving the drying in a short amount of time. Additionally, the heated hair can be cooled by operating only the suction means. When the rod main body is washed, the closing member can be removed from the rod main body for facilitating washing thereof.

Because the joint face between the rod main body and the closing member is formed in a concave/convex shape such as a wave form, the concave/convex portions of the rod main body and closing member fit to each other when the closing member is fitted to the rod main body. Consequently, the closing member never rotates relative to the rod main body thereby winding of the hair being facilitated and carried out securely.

Because the color of the closing member is different from the color of the rod main body, the direction of the closing member can be known easily when the engaging member is mounted after the hair is wound around the rod main body. Consequently, engagement between the closing member and the engaging member can be carried out easily and because the color of the closing member is changed for each color of the rod main body, the size of the rod main body can be known from the color when winding the hair. Thus, the procedure of winding the hair around the rod main body of a different size can be executed easily.

Because the closing member is constituted of at least flexible synthetic resin and a number of projecting portions are formed on an end face thereof, the projecting portions deform when the engaging member is fitted to the closing member in an oblique direction thereby facilitating the fitting work.

Further, because the small hole is made in the outer peripheral face of a side having a shorter length partitioned by the partition wall formed inside the rod main body, liquid such as permanent wave treatment agent flows out but not being collected inside, thereby eliminating a danger that the clothes may be stained by fluid collected inside when the rod is removed from the hair.

In example 30 to 34 of the present invention, the treatment time and treatment temperature are set by inputting one or more conditions about the number of the rods, quantity of the hair and damage condition of the hair through a control switch provided on the control panel before the procedure for acceleration of the hair treatment is executed. Consequently, the permanent wave treatment can be executed by a person having no much experience and thus an object person is never provided with feeling of uneasiness. Setting by a skilled person is not required, thereby reducing the treatment time.

Because the treatment time and treatment temperature are determined by inputting the number of the rods, amount of the hair and damage condition of the hair as setting conditions, the treatment can be carried out according to the hair condition of the object person so that the permanent wave condition can be maintained in a longer period.

Further, because switches for inputting the conditions are disposed on the outer periphery of the control panel and the indication portion which indicates a condition set by the switch and the indication portion which indicates a set treatment time and treatment temperature are disposed inside of the area in which the switches are disposed, excellent operability is secured and the indication portions are easy to see and additionally a unique design is obtained.

Because the correction switches for changing the treatment time and treatment temperature are disposed at the portion in which various switches are provided of the control panel, the treatment time and treatment temperature can be changed freely during a treatment so that more appropriate permanent wave treatment can be carried out.

BEST MODE FOR CARRYING OUT THE INVENTION

Figure 1:
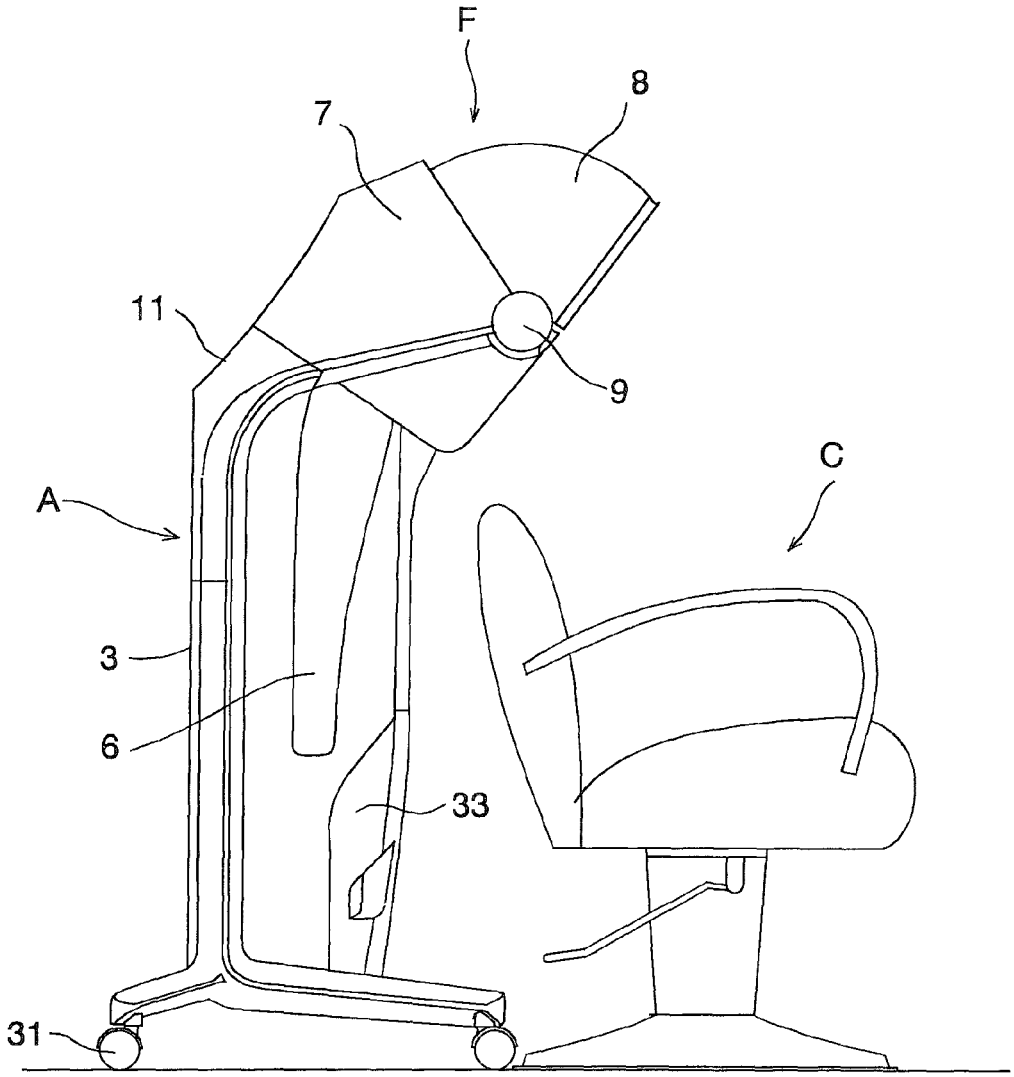
FIG. 1 is a side view of a permanent wave treatment apparatus of a first embodiment.

According to the present invention, the hair of an object person is wound around a rod having a number of ventilation holes and a tube is connected to the rod to suck with blower while hot air is supplied into a hood from the blower.

First Embodiment

Hereinafter the embodiments of the permanent wave treatment apparatus of the present invention will be described with reference to FIGS. 1 to 15.

The permanent wave treatment apparatus of the present invention mainly comprises a main body A constituted of a blower 1 which sucks hot air sucked from the rod R and exhausts air heated by a heater H and a housing 3 accommodating the blower 1 and a steam separator 2 which separates the hot air sucked by the blower 1, water content, chemical agent for permanent wave treatment and foreign matter; and a hood F which is attached detachably to the top of the housing 3 and is constituted of two separated components which can be opened/closed. In the meantime, reference symbol C denotes a chair on which an object person is to be seated upon permanent wave treatment. The main body A is provided with a caster 31 which allows the apparatus to be moved freely.

Next, the detail of the main body A will be described. The blower comprising a motor and a fan is fixed to the central portion within the housing 3 and hot air within the hood F is sucked through the hair wound around the rod R by keeping the interior of the rod R in a negative pressure and supplied to a steam separator 2 disposed on the bottom. The steam separator 2 sucks air containing no liquid such as chemical agent or foreign matter and discharges the sucked air to a heater H installed on the top to return air heated at a predetermined temperature by the heater H into the hood F from an outlet hole 32 formed in the housing 3. Although in the embodiment of the present invention, a method of disposing the heater H above the blower 1 and supplying hot air into the hood F by heating air from the blower 1 has been described, the hot air to be supplied to the hood F may be fed by sucking outside hot air as long as the interior of the hood can be kept in heated environment.

The steam separator 2 comprises a vortex generating unit 21 which is located just below the blower 1 and generates vortex in sucked air and discharges downward, a cup 22 which is attached detachably to the bottom of the vortex generating unit 21 so as to store chemical agent and foreign matter contained in brackish water from the blower 1 and a funnel-like separator 23 which is accommodated removably in the cup 22 and has a slit 23*a* for feeding chemical agent and foreign matter contained in vortex into the cup 22. The cup 22 in the steam separator 2 can be taken out by opening a lid 33 attached to the front of the housing 3 such that it can be opened/closed freely to discharge fluid collected in the cup 22.

Figure 4:
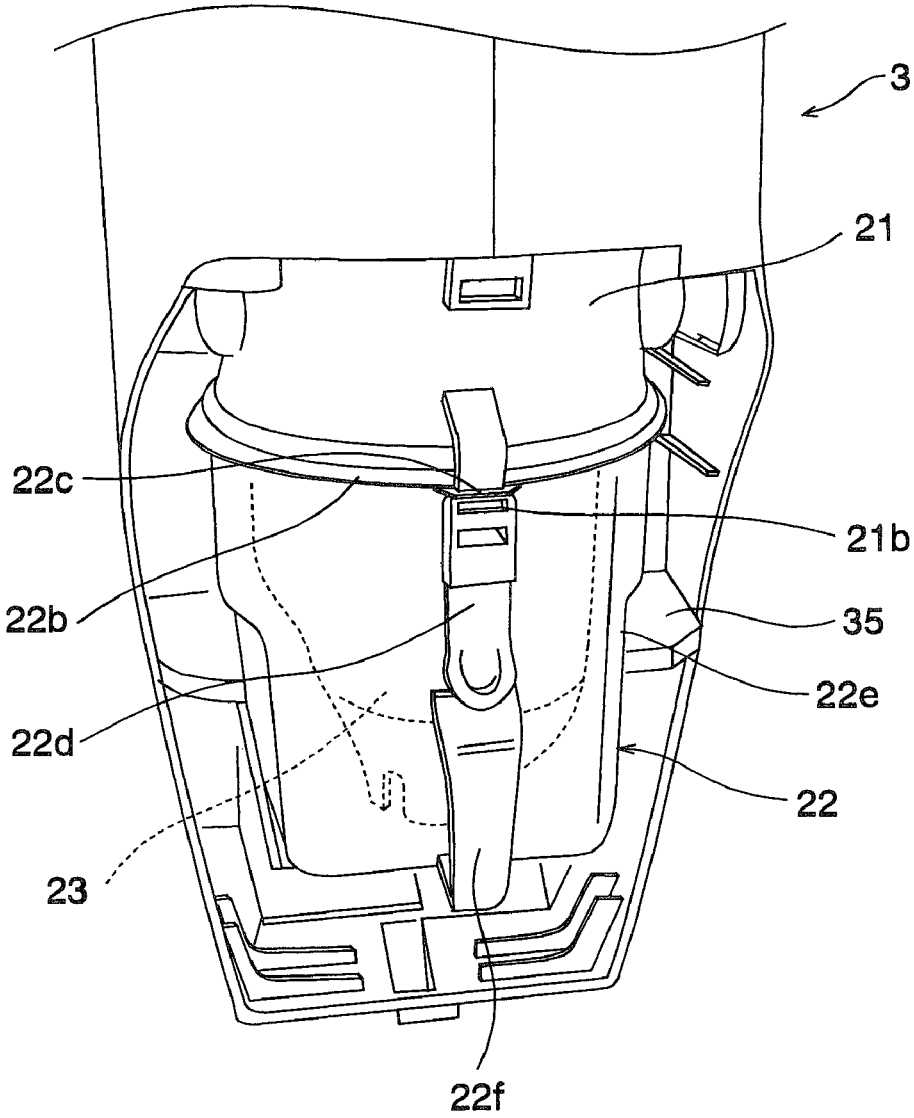
FIG. 4 is a front view of a condition in which a cup is attached to a vortex generating unit mounted within a housing of a steam separator.
Figure 5:
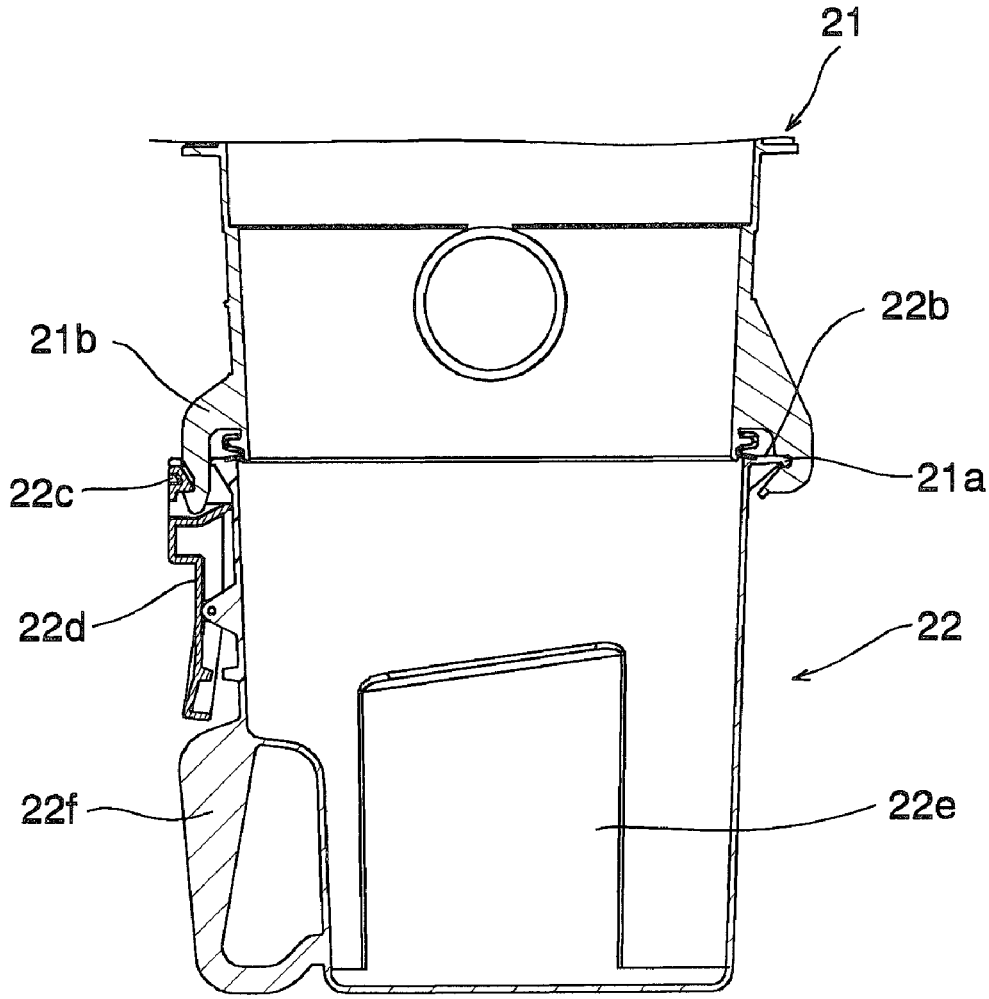
FIG. 5 is a sectional view of FIG. 4.
Figure 6:
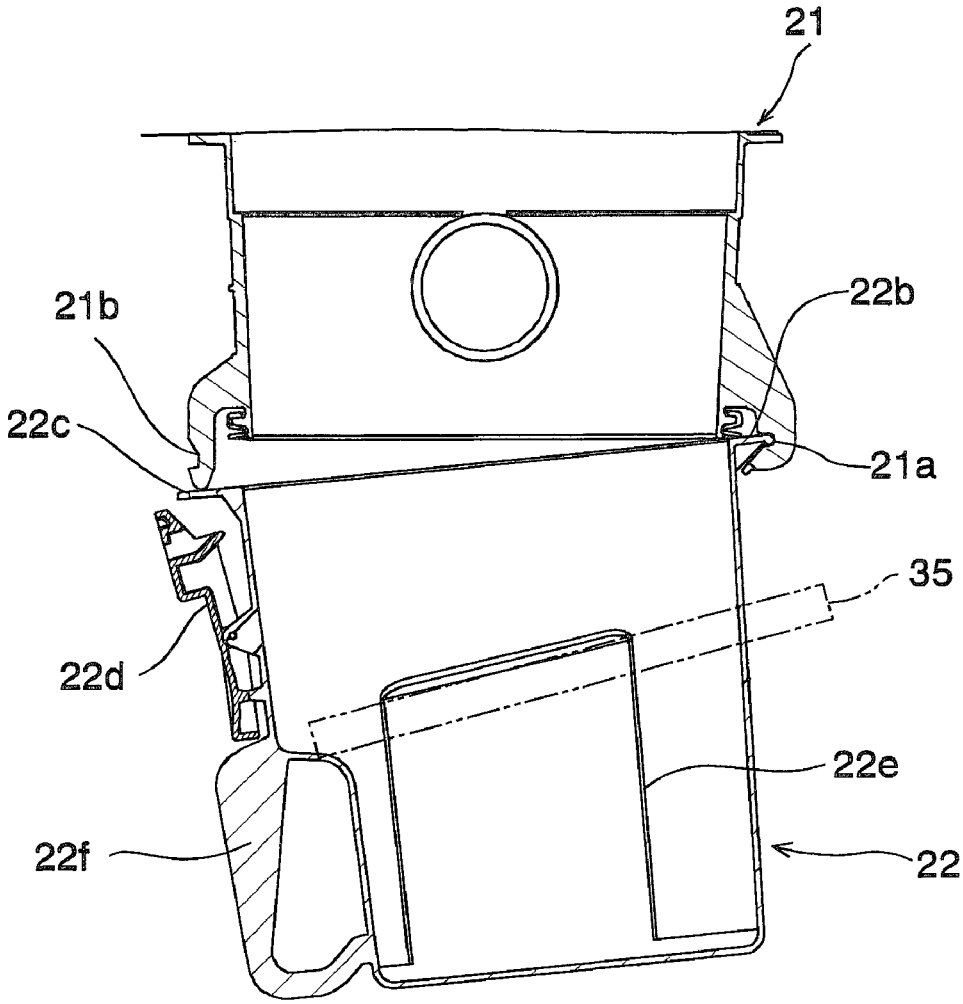
FIG. 6 is a sectional view showing a condition in which the cup is being removed from the vertex generating unit.

The cup 22 is attached detachably to the vortex generating unit 21 and has a structure shown in FIGS. 4 to 6. That is, the vortex generating unit 21 has an engagement groove 21*a* which engages a jaw portion 22*b* of the cup 22 and further a locking pawl 21*b* on an opposite side to the engagement groove 21*a* thereof. On the other hand, an opening hole 22*c* which the locking pawl 21*b* passes through is formed in the jaw portion 22*b* of the cup 22 and a handle 22*d* is mounted rotatably to be engaged with the locking pawl 21 passing through the opening hole 22*c* so that it can be locked. The cup 22 is formed such that the top portion is cylindrical while a stepped portion 22*e* is formed on a face in the same direction as the rotation direction of the handle 22*c*, below the intermediate portion. In the opening portion of the housing 3, a guide rail 35 on which the bottom face of the stepped portion 22*e* of the cup is to be placed is formed such that it is inclined toward the opening portion side. In the meantime, reference numeral 22 denotes a handle of the cup 22.

To install the cup 22 onto the vortex generating unit 21 under such a structure, with the stepped portion 22 of the cup 22 riding on the guide rail 35 in the opening portion of the housing 3, the cup 22 is inserted by sliding and consequently, the cup 22 is stopped with the jaw portion 22*b* of the cup 22 engaged with the engagement groove 21*a* in the vortex generating unit 21. If the handle 22*f* of the cup 22 is pushed upward in this condition, the locking pawl 21*b* invades into the opening hole 22*c* formed in the jaw portion 22*b* so that its front end passes through the opening portion 22*c*. If the handle 22*d* is rotated at this time, the top end of the handle 22*d* engages the locking pawl 22*b* so that it is locked.

The outlet hole 32 is provided in a slope on which the hood F is to be mounted of the top face of the housing 3 and extraction members 5 from which the tubes 4 for keeping the interior of the rods R in a negative pressure are extracted are attached on the right and left of this outlet hole 32. An attachment device 41 rotatable to the rod R is provided at the end of the tube 4 such that it can be attached to and detached from the rod R. Because a number of air circulation holes R1 are formed in the outer peripheral face of the rod R, the tube 4 is connected to the rod R through the attachment device 41 and when the interior of the tube 4 is turned into a negative pressure, the interior of the rod R turns into a negative pressure. Consequently, fluid adhering to the hair wound around the rod R is sucked into the tube 4 and at the same time, when the interior of the hood F is heated, the hair is also heated so as to accelerate drying.

Figure 7:
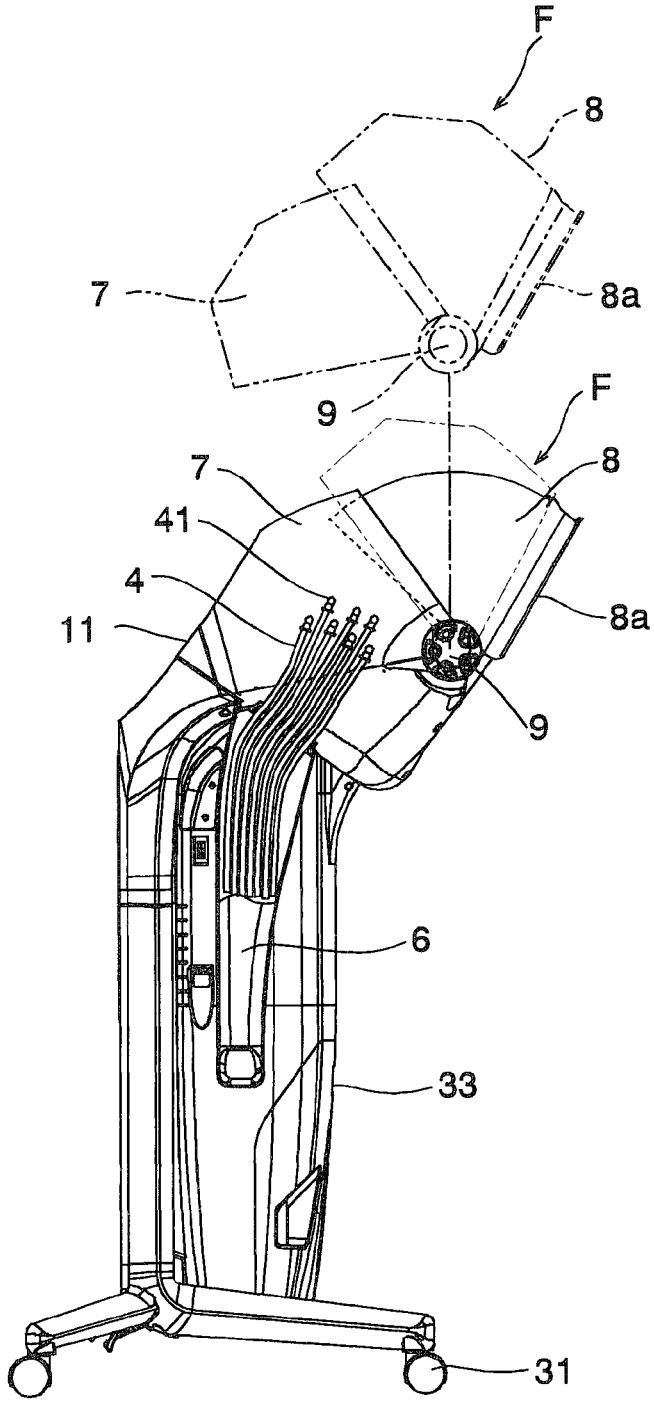
FIG. 7 is a partially broken side view of FIG. 1.

The extraction member 5 for the tube 4 comprises a fixing base 51 in which elongated holes 51*a* each having a diameter larger than the diameter of the tube 4 are formed and a movable base 52 in which circular holes each slightly larger than the tube 4 are formed and can slide relative to the fixing base 51. Extraction or accommodation of the tube 4 can be carried out easily by sliding such that the circular holes 52*a* in the movable base 52 are aligned with the center of the elongated holes 51*a* in the fixing base 51 as shown in FIG. 6 and to fix the tube 4, as shown in FIG. 7, the movable base 52 is slid so that the circular holes 52*a* in the movable base 52 go out of the center of the elongated holes 51*a* in the fixing base 51 and consequently, the tubes 4 are fixed by frictional resistance.

The structure of the extraction member is not restricted to the above-described embodiment but any structure which can be fitted to the outer periphery of the tube 4 and form a gap relative to the outer periphery may be adopted. The fixing base 51 is fixed to a foundation 53 in which the tubes 4 are inserted relatively in a high density. The top end of a suction pipe 6 described later is coupled with this foundation 53 in air-tight condition. A cap (not shown) needs to be fitted to the attachment device 41 of the tube 4 on which no rod R is mounted in order to prevent the suction force of the rod R from weakening at the time of suction.

The suction pipe 6 which accommodates the tubes 4 hanging from the extraction member 5 is formed of synthetic resin or the like into a pipe-like shape and an end thereof is fitted to the foundation 53 of the extraction member in air-tight condition while the other end thereof is fitted to a mating side face of the vortex generating unit 21 of the steam separator 2 in air-tight condition. Then, the suction pipes 6 are disposed along the side faces of the housing 3. Therefore, when the blower 1 is driven, the interior of the suction pipe 6 turns into a negative pressure by the vortex generating unit 21, so that the interior of the tube 4 turns into a negative pressure by this negative pressure condition thereby the interior of the rod R being kept in a negative pressure.

When the suction pipe 6 fitted to the extraction member 5 and the vortex generating unit 21 in air-tight condition is removed, the suction pipe 6 can be separated from the housing 3. Consequently, the tubes 4 can be pulled out of the suction pipe and the tubes 4 can be cleaned easily.

Next, the detail of the hood F will be described with reference to FIGS. 11 to 14.

The hood F is constituted of a first hood 7 and second hood 8 formed in a substantially circular shape, tightening member 9 which rotates at the vertex portion of the first and second hoods and tightens, and a locking member 10 capable of locking only the second hood 8. It is fitted to a receiving concave portion 34 of the housing 3 via the tightening member 8 and the locking member 10 and installed removably. In the meantime, the shapes of the first and second hoods 7, 8 are not limited to the circular shape but any shape may be adopted, for example, square, hexagonal shapes as long as it can cover the head.

When the hood is installed in the receiving concave portion 34 in the housing 3, the first hood 7 is mounted in top opening edge portion of the housing 3 in a fitted condition and an air-tight flexible covering cloth 8*a* is attached detachably to the opening portion of the second hood 8 in order to cover the head of an object person including the forehead to the neck. A stopper spring 8*b* which engages a projection (not shown) formed on the inner face of the first hood 7 is attached on the second hood 8 in order that the second hood 8 not to move easily in an opening direction when the second hood 8 is rotated in a direction of overlapping the first hood 7.

Figure 2:
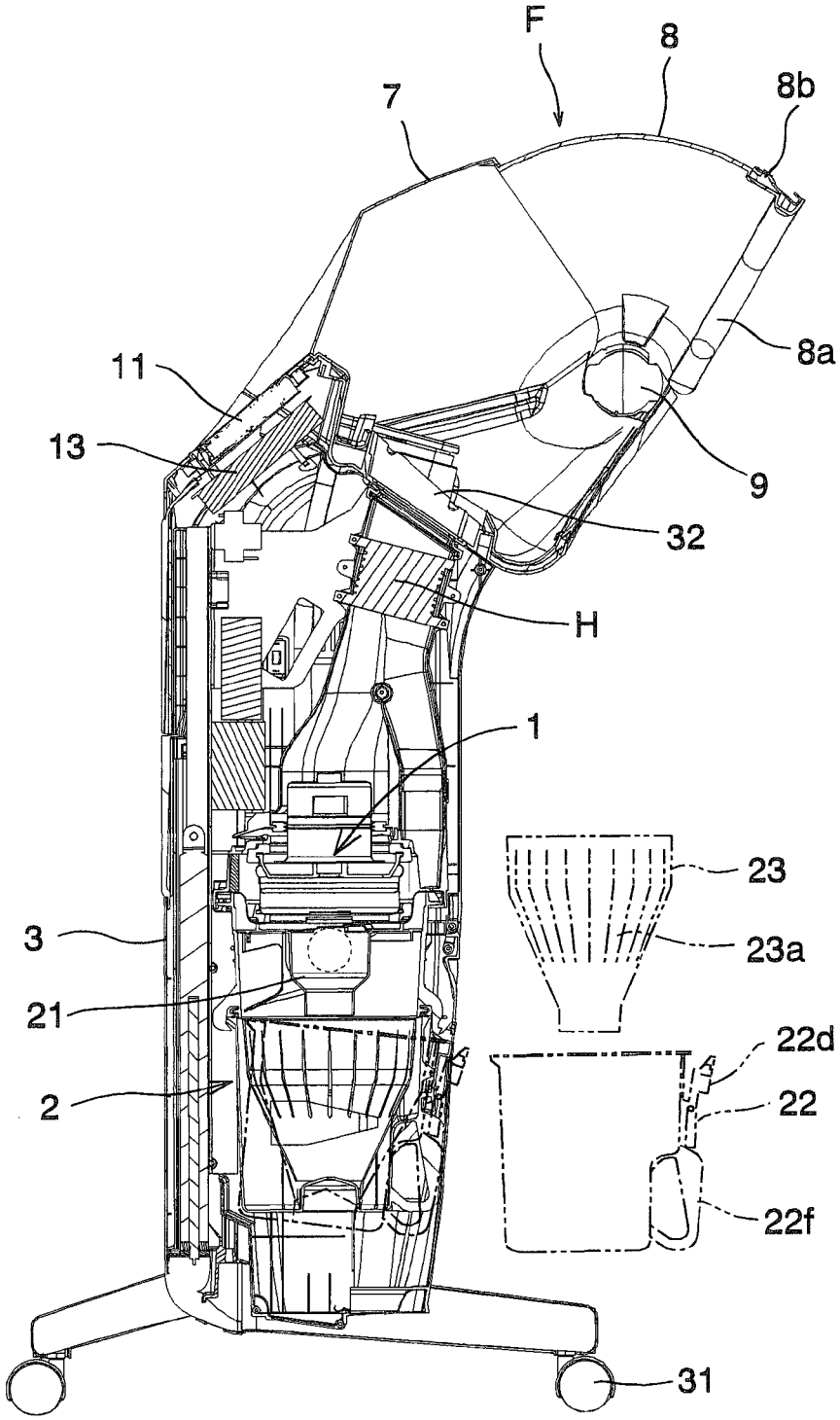
FIG. 2 is a longitudinal sectional view of FIG. 1.
Figure 3:
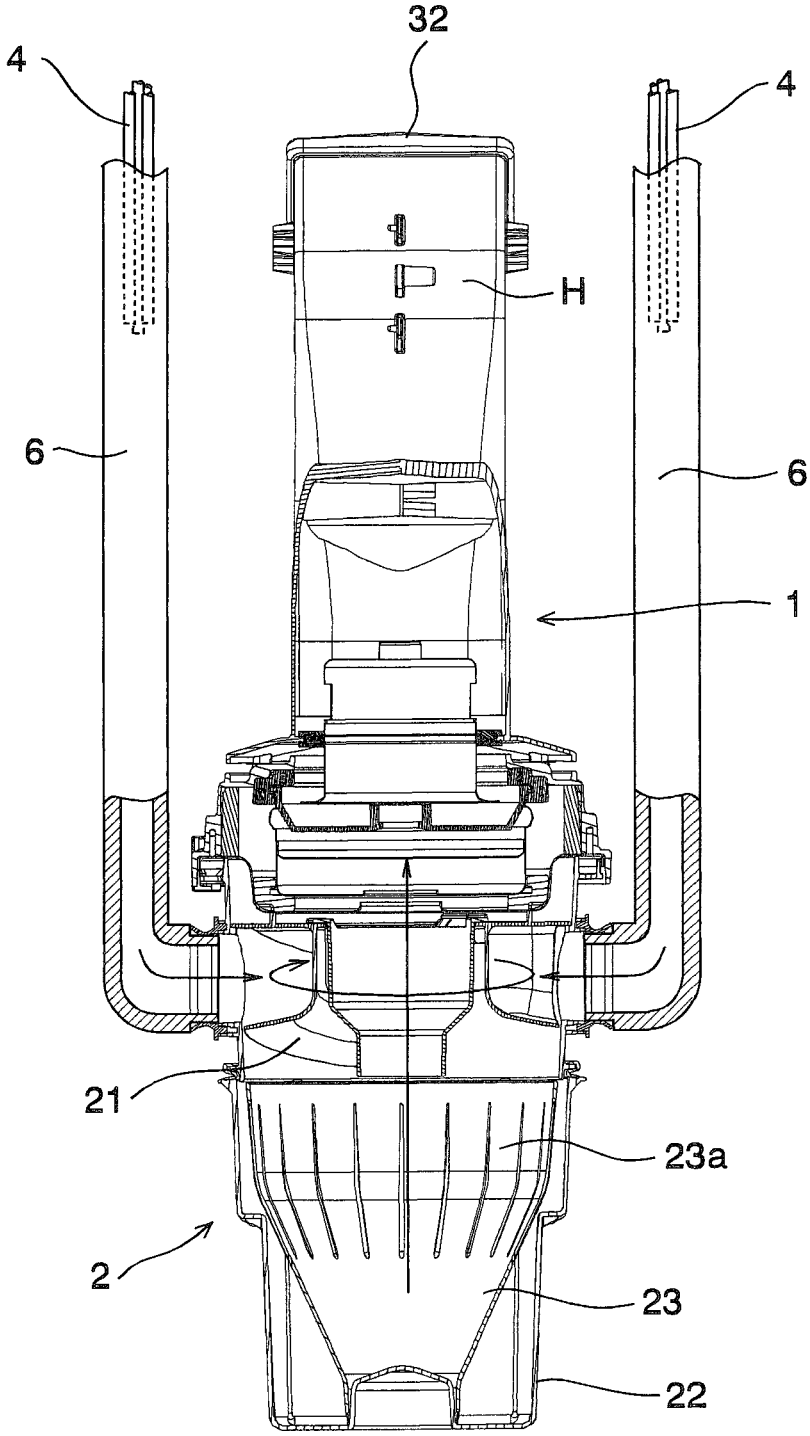
FIG. 3 is a rear view of major portion.
Figure 14:
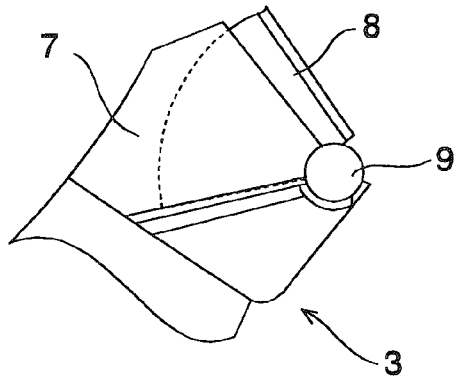
FIG. 14 is a side view showing opening/closing condition of the first and second hoods, FIG. 14(*a*) shows a condition at an introduction time, FIG. 14(*b*) shows a condition when connecting the rod and tube at the rear head and FIG. 14(*c*) shows a condition when connecting the rod and tube at the forehead.
Figure 14:
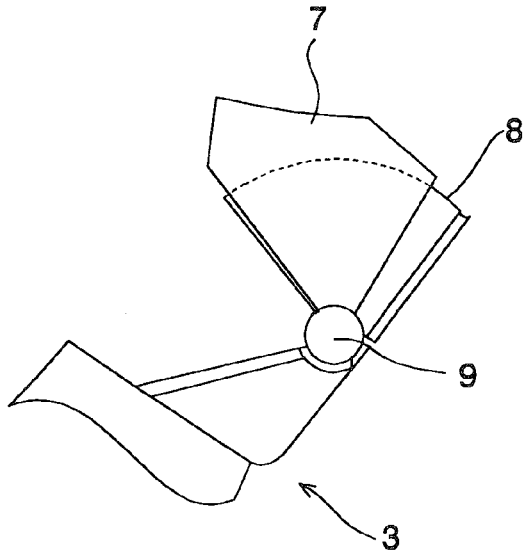
Figure 14:
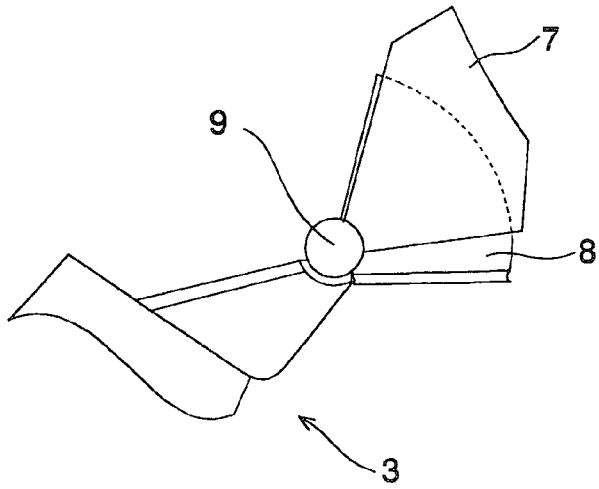

The tightening member 9 can be fixed so as to locate the first hood 7 and the second hood 8 at a predetermined angle (for example, a position which allows a procedure of fitting the tube 4 to the rod R to be carried out easily from the rear head side of the object person seated by overlapping the second hood 8 with the second hood 8 as shown in FIG. 14(*b*) and a position which allows a procedure of fitting the tube 4 to the rod R to be carried out easily from the forehead side of the object person by overlapping the second hood 8 with the first hood 7 with the second hood 8 positioned on the face side as shown in FIG. 14(*c*)) by rotating a knob 91. Further, the locking member 10 locks the second hood 8 when the second hood 8 is opened to a maximum extent relative to the first hood 7 (FIGS. 1 and 2).

Next, the structure of the tightening member 9 will be described with reference to a sectional view of FIG. 11.

Figure 11:
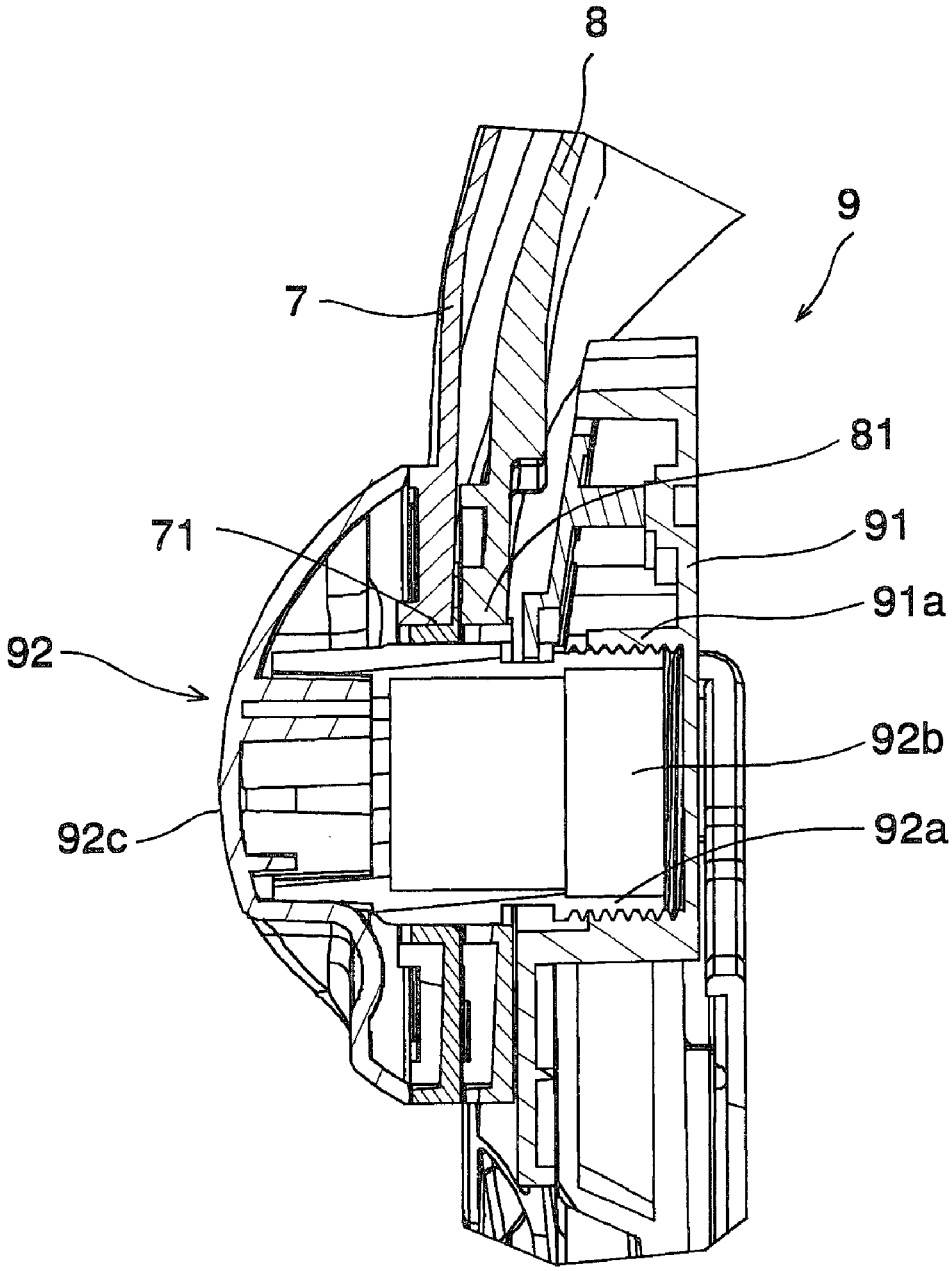
FIG. 11 is a sectional view of tightening member for integrating first and second hoods.

Referring to FIG. 11, reference numeral 91 denotes a mounting member which can be mounted detachably to the receiving concave portion 34 in the housing 3 and a female screw 91*a* is formed in the center. Reference numeral 92 denotes a screw member in which a cylindrical portion 92*b* including a male screw 92*a* which engages the female screw 91*a* is formed and an operating knob 92*c* having an uneven surface which facilitates a rotation thereof with the fingers is formed at the front end. Holes 71, 81 formed at the vertex portions of the first and second hoods 7, 8 are supported by the cylindrical portion 92*b*.

When the male screw 92 of the screw member 92 is loosened relative to the female screw 91*a* of the mounting member 91 in the tightening member 9 having such a structure, an interval between the first and second hoods 7, 8 is widened so that the both turn capable of rotating. When it is tightened, the interval between the mounting member 91 and the screw member 92 is narrowed so that the first and second hoods 7, 8 are fixed together. Thus, an overlapping angle between the first hood 7 and the second hood 8 and a rotation angle of the first and second hoods 7, 8 to the housing 3 shown in FIG. 11 can be set freely.

Next, the structure of the locking member 10 will be described with reference to FIGS. 12 and 13.

Figure 12:
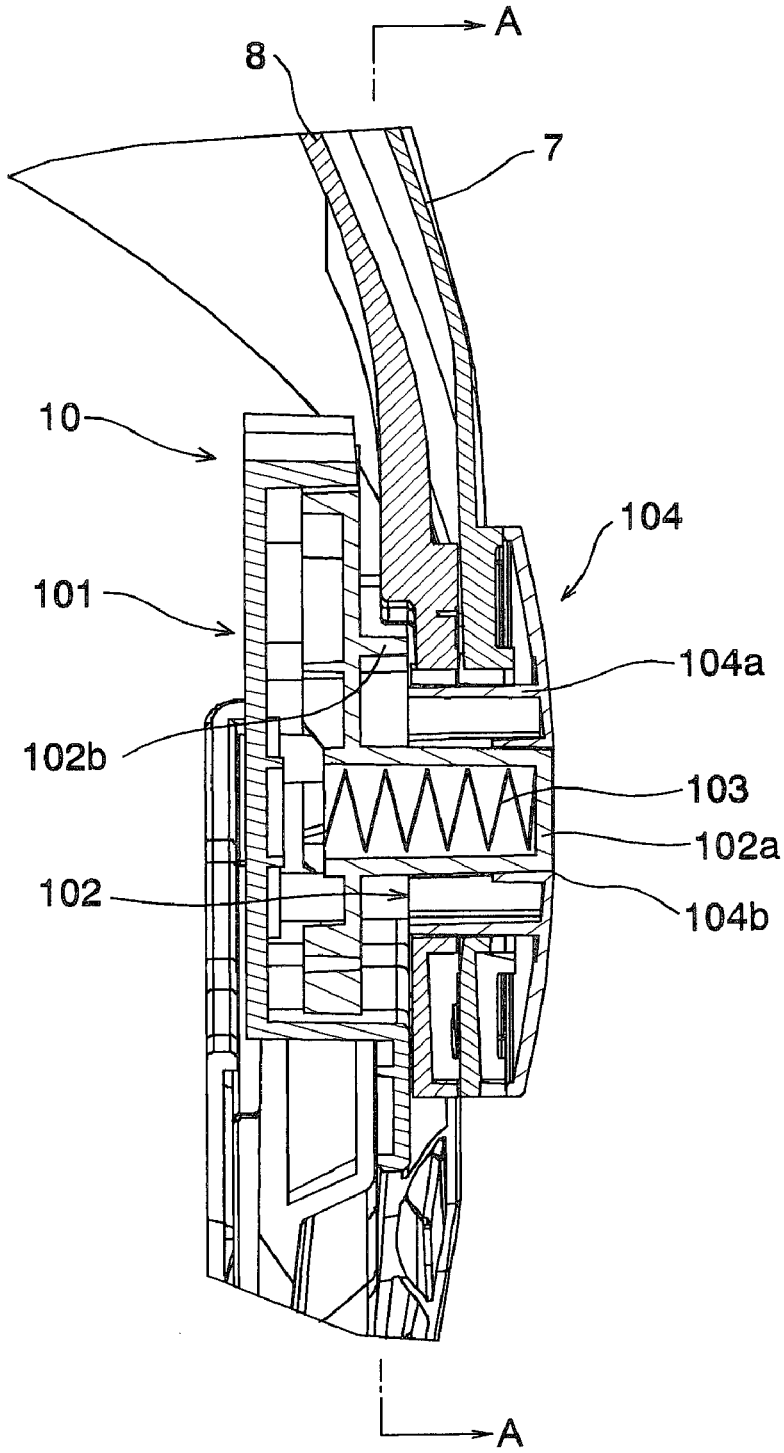
FIG. 12 is a sectional view of a locking member for locking the second hood.
Figure 13:
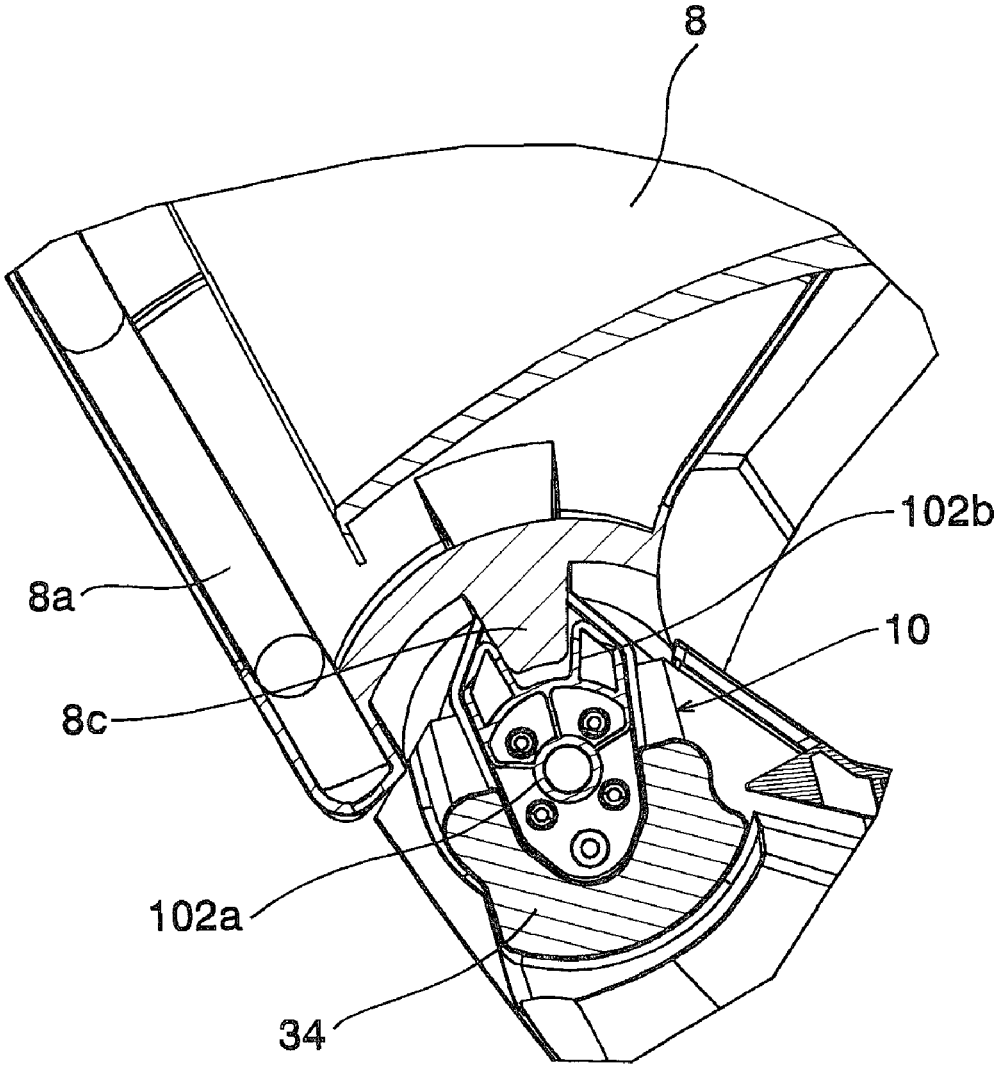
FIG. 13 is a sectional view taken along line A-A of FIG. 12.

Referring to FIGS. 12 and 13, reference numeral 101 denotes a mounting member which can be mounted detachably in the receiving concave portion 34 formed on an opposite side to the receiving concave portion 34 in which the mounting member 91 of the tightening member 9 is mounted. Reference numeral 102 denotes an operating member which is mounted slidably (slidable in the right-left direction in FIG. 12) in the mounting member 101 and in which an operating knob 102*a* is formed integrally and a spring 103 is accommodated in the operating knob 102*a*. A concave engaging portion 102*b* which a wedge-like engaging projection 8*c* formed on the inner face of the second hood 8 is to engage is formed in the operating member 102. In the meantime, the engaging projection 8*c* is formed at a position in which it engages the engaging portion 102*b* when the second hood 8 is rotated up to a treatment position in FIGS. 1 and 2.

Reference numeral 104 denotes a cap attached to the mounting member 101 and a cylindrical portion 104*a* by which holes formed at the vertex portion of the first, second hoods 7, 8 are supported rotatably is formed in the cap 104 and a knob hole 104*b* which the front end of the operating knob 102*a* faces is formed. When the operating knob 102*a* exposed from the knob hole 104*b* in the cap 104 is pressed against a spring force of a spring 103, if the engaging projection 8*c* formed on the second hood 8 is located as shown in FIG. 13, the engaging projection 8*c* engages the engaging portion 102*b*, so that the second hood 8 is locked at this position and cannot be rotated.

In the locking member 10 having such a structure, when the second hood 8 is rotated up to a position which enables permanent wave treatment (conditions of FIGS. 1 and 2), the operating knob 102*a* is pushed against the spring force of the spring 103. When the pressing force of the operating knob 102*a* is released at a position in which the engaging projection 8*c* of the second hood 8 reaches the engaging portion 102*b*, the operating member 102 is returned to its original position by the spring force of the spring 103 so that as shown in FIG. 13, the engaging projection 8*c* engages the engaging portion 102*b* thereby blocking a rotation of the second hood 8. Because the second hood 8 is locked and never moved during a treatment procedure, the object person can feel the safety during the treatment.

Next, a control unit for treatment of the hair using the permanent wave treatment apparatus will be described with reference to FIGS. 15 to 17.

Figure 15:
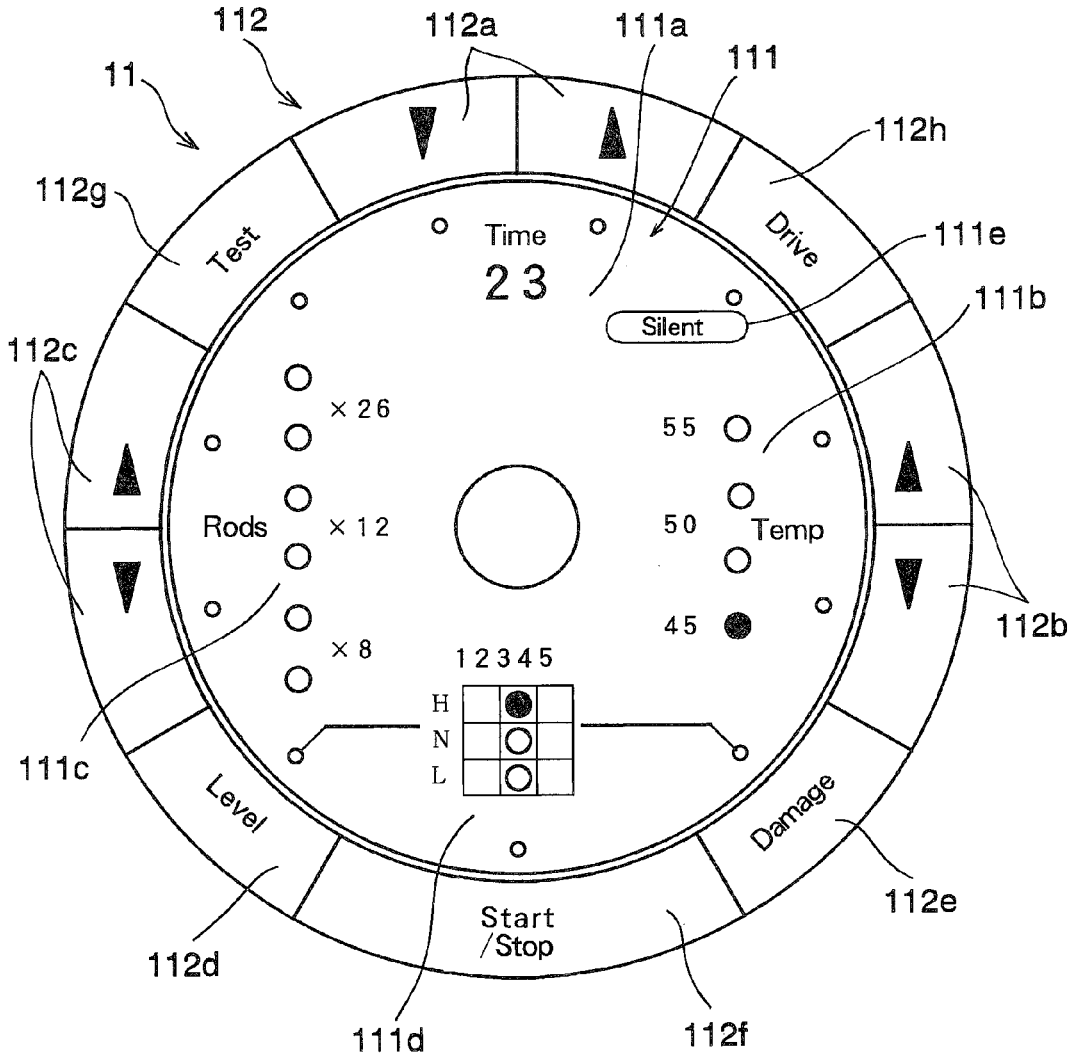
FIG. 15 is a front view of a control panel.
Figure 16:
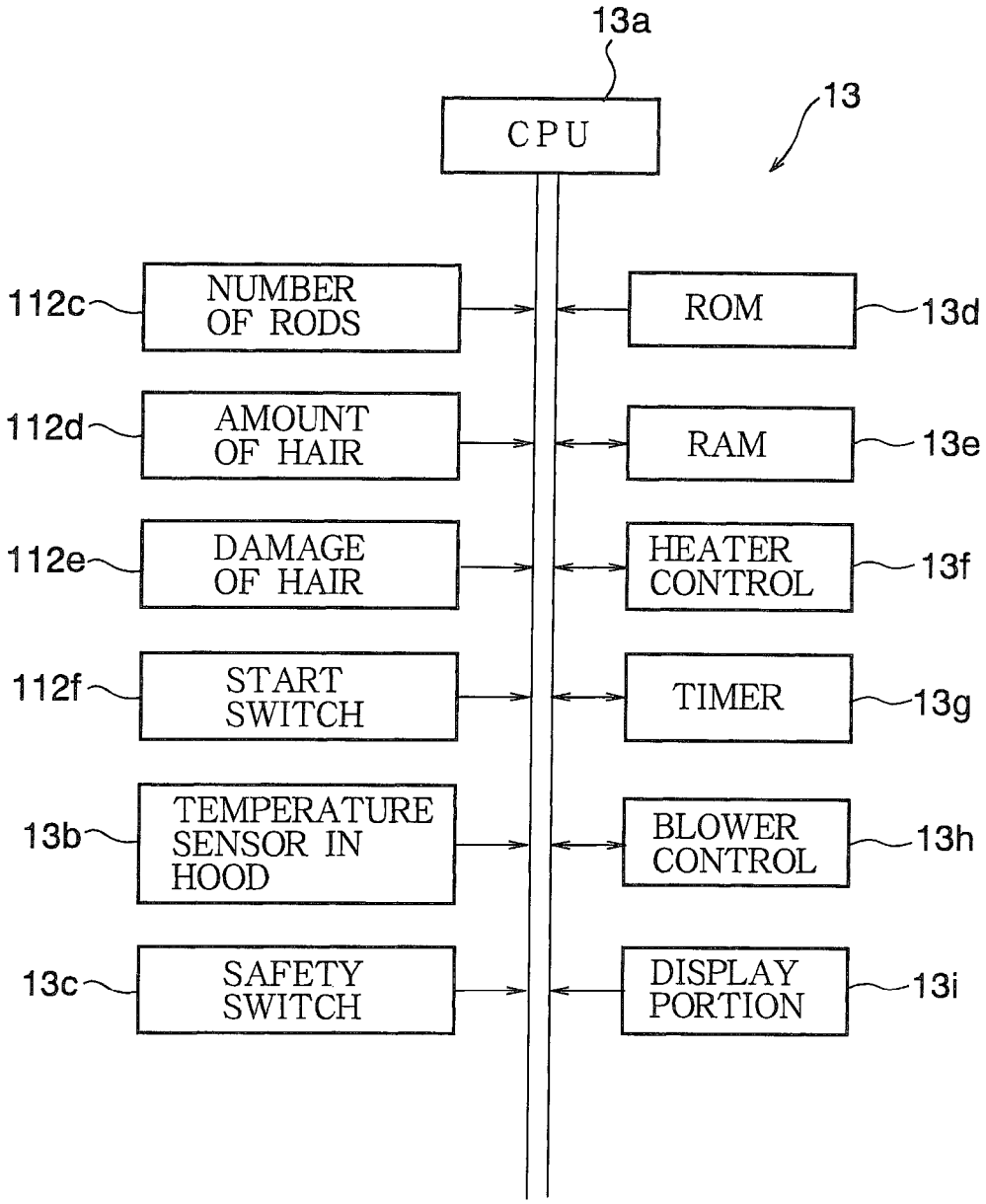
FIG. 16 is a circuit block diagram of the control panel.
Figure 17:
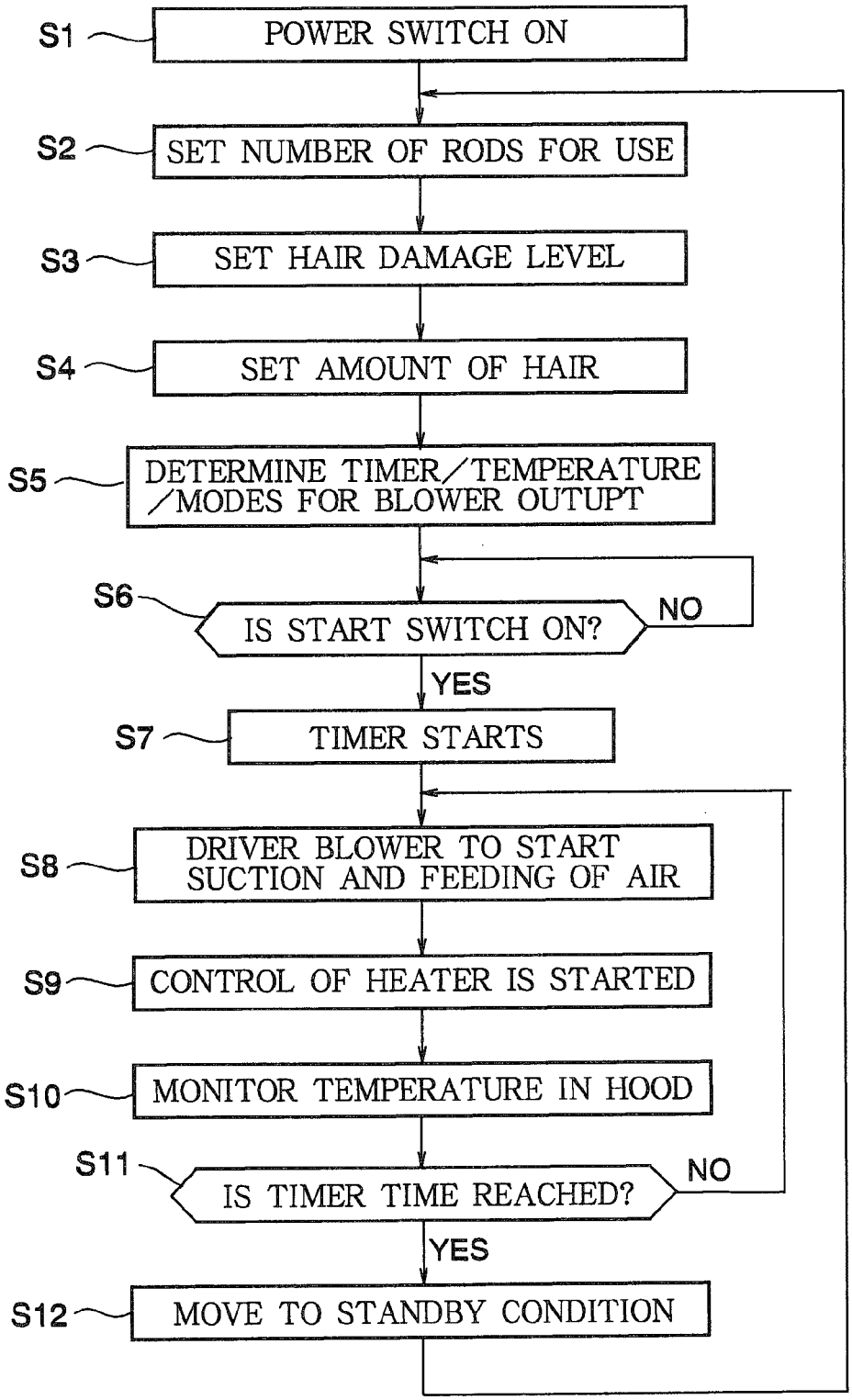
FIG. 17 is a flow chart showing the operation of the control circuit.

FIG. 15 is a front view of a control panel 11 attached to a slope at the vertex of the housing 3 of the treatment apparatus, FIG. 16 shows a control circuit which is driven by operation by the control panel 11 and FIG. 17 is a flow chart for explaining the operation of the control circuit 13.

First, the control panel 11 will be described. It is entirely formed in a disc shape and a ring-like control portion 112 is formed on the outer periphery while an indication portion 111 is formed inside the control portion 112. The indication portion 111 is constituted of a time indication portion 111*a* which indicates a treatment time in numeral, a temperature level indication portion 111*b* which indicates a treatment temperature by change-over of a light emission diode, a rod number indication portion 111*c* which indicates the number of rods R around which the hair is wound by change-over of the light emission diode and a mode indication portion 111*d* which indicates a level 1 to 9 (light emission diodes are lit on the grid-shaped indicating portion) depending on the amount of the hair and damage of the hair of the object person.

As for the light emission diodes in the temperature level indication portion 111*b*, lighting of a blue light emission diode indicates heater control OFF and the temperature indication of 45° C. to 55° C. is carried out with a blue, two yellows, two oranges, and two reds totaling seven, disposed in line, which are lit successively as the temperature rises. As for the light emission diodes of the rod number indication portion 111*c*, two yellow light emission diodes are lit when 1 to 9 pieces are used, two orange light emission diodes are lit when 10 to 17 pieces are used, and two red light emission diodes are lit when 18 to 26 pieces are used. Although a case of indicating the number of the rods in three steps has been described in the above description, the present invention is not restricted to three steps but the number of the rods at each step is not restricted to the above-mentioned number.

Next, switches 112*a* to 112*h* disposed on the outer periphery of the indication portions 111*a* to 111*d* will be described.

Reference numeral 112*a* denotes a switch for time correction (treatment time set by the control circuit 13 described later is corrected by a practitioner according to his or her experience) and an upward arrow indicates a time incremental switch while a downward arrow indicates a time detrimental switch. Reference numeral 112*b* denotes a temperature correction switch which the practitioner operates in the same way as for time correction and an upward arrow indicates a temperature rise switch while a downward arrow indicates a temperature fall switch.

Reference numeral 112*c* denotes a rod number setting switch for setting the number of the rods R on which the hair to be wound and an upward arrow indicates a multiple number switch which is operated when the number of the rods on which the hair is wound is large while a downward arrow indicates a small number switch which is operated when the number of the rods is small. Reference numeral 112*d* denotes a hair amount setting switch which is operated according to three levels (small, normal, large) of the amount of the hair wound around the rod. Reference numeral 112*e* denotes a damage setting switch which is operated according to three levels (good, normal and bad) of damage of the hair. A level 1 to 9 memorized in a ROM of the control circuit 13 described later is automatically set according to the number of operations of the hair amount setting switch 112*d*.

Reference numeral 112*f* denotes a start switch which is operated after the time and temperature levels are automatically set by the control circuit 13 and stopped if it is operated during its operation. Reference numeral 112*g* denotes a test switch for supplying wind into the hood to keep the interior of the rod in a negative condition only when this switch is turned ON and verifying whether or not any tube not connected to the rod R is open by detecting sound or current in the blower. Reference numeral 112*h* denotes a sound reduction switch for reducing the output in order to reduce an operating sound (sound generated when air is sucked while the wind is supplied) and when the sound reduction switch 112*h* is operated, a silent lamp 111*e* is lit.

Next, the control circuit 13 of FIG. 16 will be described. The same reference numerals as those used for explaining the control panel 11 indicate the same component and description thereof is omitted.

Reference numeral 13*a* denotes a CPU for operating the entire circuit, reference numeral 13*b* denotes a temperature sensor which is installed at a predetermined location within the hood for detecting the temperature of the interior of the hood, and reference numeral 13*c* denotes a safety switch which supplies hot air, detects that overload is applied to a motor for suction and turns OFF the power supply when a tilt sensor installed in the main body detects that the main body falls down or a heater reaches an abnormal temperature.

Reference numeral 13*d* denotes a ROM which memorizes data indicating how many minutes a treatment is carried out and what temperature is set in the treatment by inputting through the rod number setting switch 12*c*, the hair amount setting switch 12*d* and the damage setting switch 12*e*. Reference numeral 13*e* denotes a RAM which memorizes various settings carried out by the practitioner according to his or her desire. Reference numeral 13*f* denotes a heater control portion for a relay which control the temperature of a heater, for example, controls ON/OFF supply of power to the heater. Reference numeral 13*g* denotes a timer which subtracts from time set by the ROM 13*d* since the start switch 12*f* is turned ON, reference numeral 13*h* denotes a blower control portion which controls ON/OFF of the air feeding means and the amount of air feeding. Reference numeral 13*i* denotes a control portion which controls lighting of the display portion 111. These switches and control portions are connected to the CPU 13*a* through I/O bus.

Next, the operation of the control circuit 12 will be described with reference to the flow chart of FIG. 17.

After an object person is seated in front of the permanent wave treatment apparatus of the present invention with the hair wound around the rods R, the attachment device 41 is fitted to the rod R and a sealing member is fitted to a connecting portion for the attachment device 41 of the rod R provided with no attachment device 41 to prevent air leakage. After that, the hood F is put on the head of an object person and sealing condition is produced with the covering cloth 8*a*.

When the switch of a main power supply (not shown) is turned ON (step S1) in this condition, the control circuit 13 is driven. A number of the rods R on which the hair is wound is input by operating the rod number setting switch 112*c* (step S2). Next, a damage state of the hair is input by operating the damage setting switch 112*e* (step S3) and further, whether or not the amount of the hair wound around the rods is large is determined and then the amount of the hair is input by operating the hair amount setting switch 112*d* (step S4).

After the above three settings are finished, hair treatment time, hair heating time and blower output intensity mode are picked up from data memorized in the ROM 13*d* and then time and temperature are determined (step S5) and displayed on the time indication portion 111*a* and the temperature level indication portion 111*b*. With this condition, the CPU 13*a* monitors to see whether or not the start switch 112*f* is operated (step S6) and if it is determined that the switch is operated, subtraction of the timer is started (step S7) and the blower 1 is driven to start air feeding (step S8). When air feeding is started, suction is carried out through the tube 4 so that the interior of the rod R is turned into a negative pressure and air passes between the hairs to accelerate drying.

At the same time when the blower is driven in the step S8, the temperature sensor 12*b* installed in the hood F detects a temperature in the hood. Because the temperature in the hood when the start switch 112*f* is turned ON is of room temperature or lower than necessary, the heater control 13*f* is started (step S9). Then, the heater control is started to obtain a predetermined temperature (temperature determined by the ROM) (step S10).

The CPU 13*a* monitors to see whether or not the set time is reached while carrying out the temperature control (step S11) and if it is determined that the set time is not reached, the procedure is returned to step S8, in which the above-mentioned control is executed and if it is determined that the set time is reached, standby status is produced (step S12) and then, the procedure is returned to step S2, which waits for startup of permanent wave treatment for a next object person.

Although a case in which timer, temperature and blower output are automatically set by inputting three conditions, that is, the number of the rods, the amount of the hair and damage condition of the hair has been described in the above-described embodiment, if it is desired to determined the timer, temperature and blower output by inputting one or two conditions of the three conditions according to experience of the object person, the treatment may be started by operating a decision switch (not shown) after the one or two conditions are input. In this case, software for determining the timer, temperature and blower output under each input condition needs to be created for the ROM 13*d*.

Next, process for permanent wave treatment using the permanent wave treatment apparatus of the present invention will be described.

First, the hair is wound around the rod R and the first agent which is a reducing agent for permanent wave is applied to the wound hair, left until the chemical agent reacts with the hair sufficiently and then the chemical agent is washed out. After that, the permanent wave treatment apparatus is set on the head of an object person. At this time, an introduction state in which the second hood 8 overlaps the first hood 7 of the hood F is produced as shown in FIG. 14(*a*).

After the object person is seated, as shown in FIG. 11(*b*), the second hood 8 is rotated up to a position in which it covers the head of the object person, so that the first hood 7 overlaps the second hood 8 and this condition is locked and fixed with the tightening member 9. With this condition, the tube 4 is extracted from the extraction member 5 and connected to the rod R on which the hair is wound. In the meantime, a cap is fitted to the attachment device 41 of the tube 4 to which no rod R is connected to block air suction. If the tube 4 cannot be connected to the rod R on which the hair of the forehead of the object person is wound under the condition of the first and second hoods 7, 8 shown in FIG. 11(*b*), the hood F may be disconnected from the housing 3 for that connection procedure.

After connection of the tube 4 to the rod R on which the hair is wound is terminated, the entire head of the object person is covered with the first and second hoods 7, 8 in an expanded condition as shown in FIGS. 1, 2. With this condition, the first and second hoods 7, 8 are locked with the stopper spring 8*b* of the second hood 8. Further, because a gap is generated between the head and an opening portion of the second hood 8, head area from the forehead to the neck rear portion of the object person is covered with the covering cloth 8*a* and isolated from outside.

Next, the control circuit 13 is turned ON by operating the start switch 112*f* and the rod number setting switch 12*c*, the hair amount setting switch 12*d* and the damage setting switch 12*e* of the control panel 11 are operated to set up treatment time and treatment temperature by activation of the control circuit 13 and the interior of the hood F is maintained at a constant temperature by set hot air. When the interior of the tube 4 turns into a negative pressure, the interior of the rod R turns into a negative pressure and when hot air passes through the rod R, the hair wound around the rod R is dried quickly. Chemical agent and foreign matter contained in the sucked hot air are separated by the steam separator 2 so that only hot air is sucked by the blower 1 and supplied into the hood F through the heater H.

After the drying process is ended, the second permanent wave treatment solution containing oxidizing agent is applied to the dried hair and left under a room temperature so as to cause internal coupling in the hair, thereby memorizing the shape in the dried condition. After oxidization of the hair is ended, the hair is washed, then dried and styled. The procedure is ended.

Second Embodiment

Although in the above embodiment, a case of supplying hot air to the hair wound around the rods and drying the hair by sucking has been described, more efficient permanent wave treatment can be executed by applying steam to the hair, then raise the temperature of the hair with much water content held on the hair (without drying the hair) and dry the hair.

Figure 18:
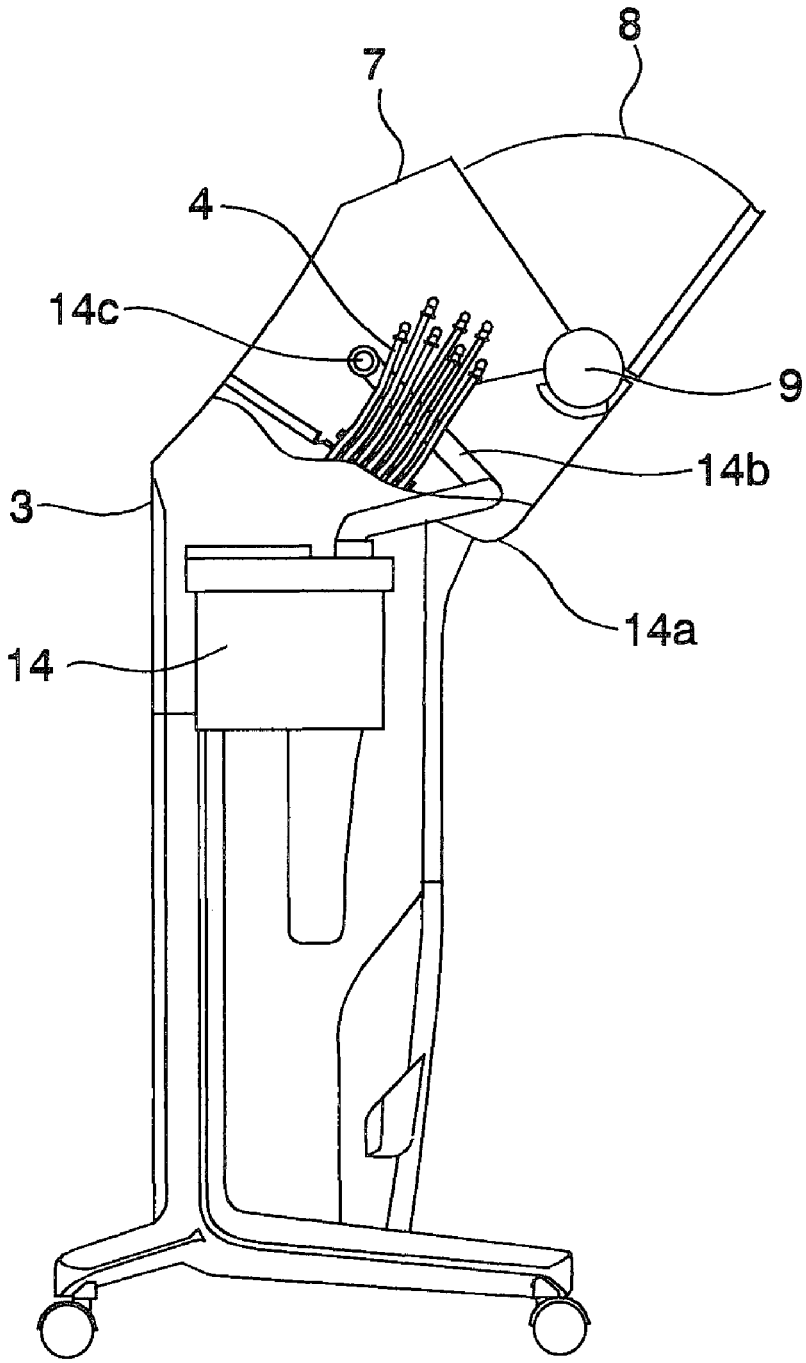
FIG. 18 is a side view of the second embodiment.
Figure 19:
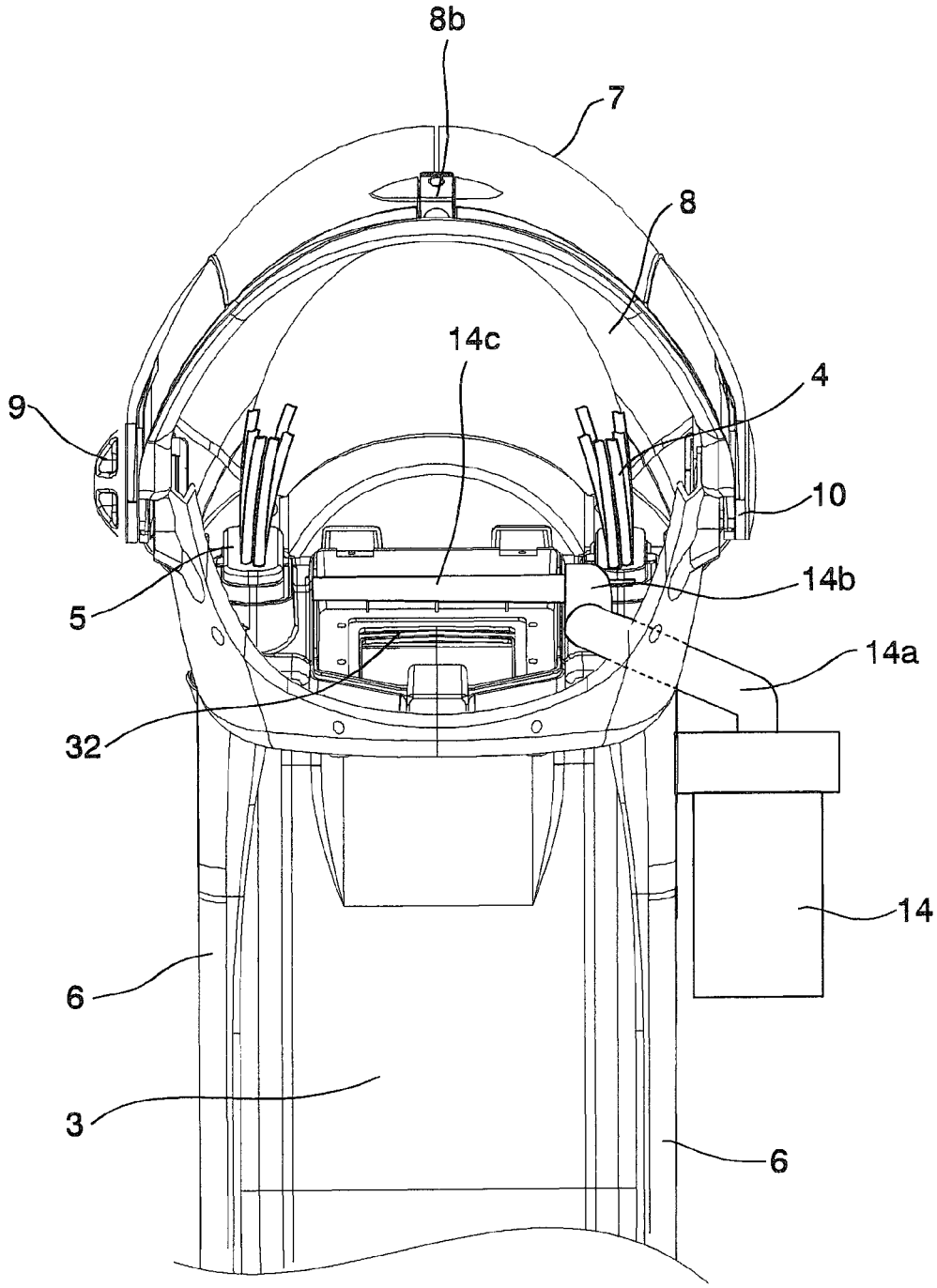
FIG. 19 is a rear view of the major portion of the second embodiment.
Figure 20:
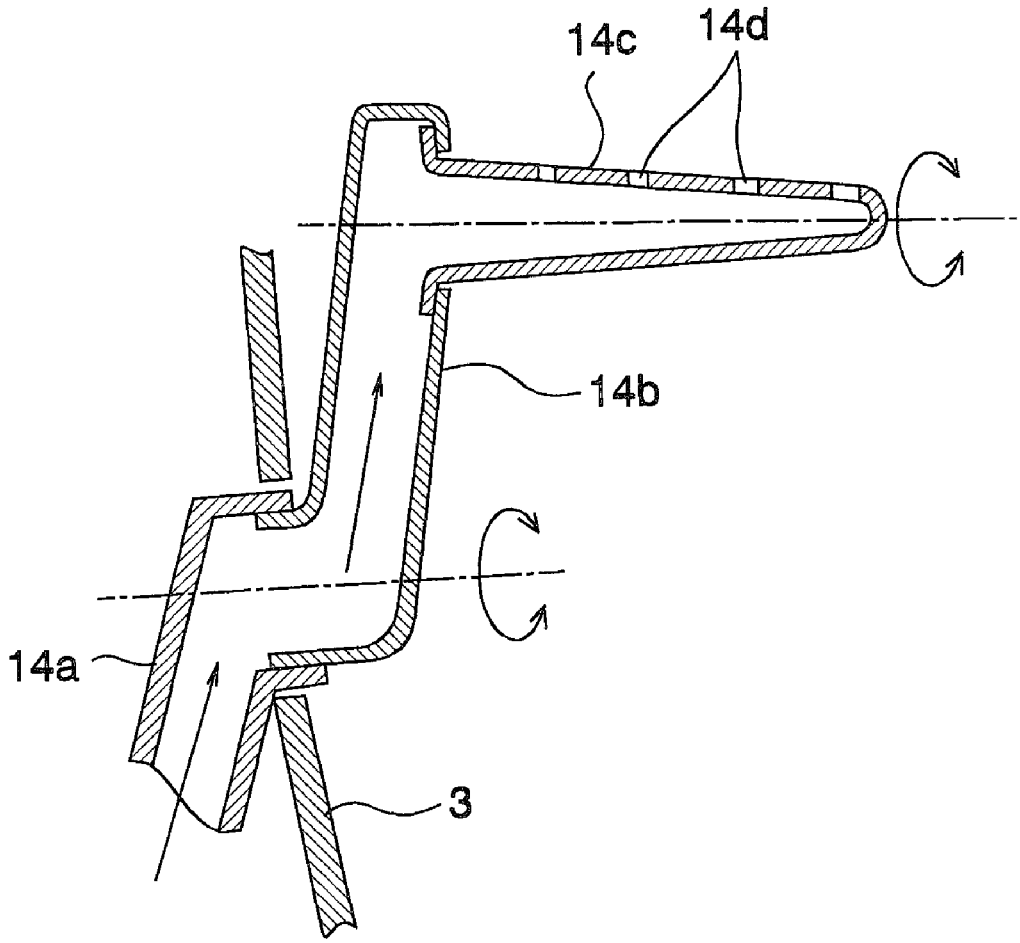
FIG. 20 is a front view of a portion which spouts steam into the hood.

The second embodiment incorporates a steam generating unit for providing steam to the hair integrally as well as the first embodiment and will be described below with reference to FIGS. 18 to 20. In the meantime, the same reference numerals as the first embodiment indicate the same component and description thereof is omitted.

Reference numeral 14 denotes a known steam generating unit installed on the side face of the housing 3, which generates steam by heating water in a tank by heater or ultrasonic wave and supplies it into the hood F through a steam pipe 14*a*.

A rotation pipe 14*b* is connected to the steam pipe 14*a* for introducing steam from the steam generating unit 4 in water-tight condition and a front end of this rotation pipe 14*b* reaches the top of the outlet hole 32 in the upper portion of the housing 3 and a steam spouting pipe 14*c* is located at the front end of the rotation pipe 14*b* in a parallel condition above the outlet hole 32. In the meantime, reference numeral 14*d* denotes a steam spouting hole.

A process of executing the permanent wave treatment using the permanent wave treatment apparatus containing the steam generating unit 14 will be described.

A point different from the permanent wave treatment by the permanent wave treatment apparatus accommodating no steam generating unit 14 exists in that the interior of the hood F is changed into heated condition by hot air with the first solution applied to the hair and steam is supplied into the hood F by the steam generating unit 14 so as to produce a condition having high humidity and temperature so as to heat the hair. Further, the hair wound around the rod R and the first chemical agent can be reacted with each other sufficiently by sucking steam slowly by combination of drive of the blower 1.

In the drying treatment process described above, the temperature of the hair can be raised with much water content contained in the hair by heating with steam before the drying treatment. Consequently, more faithful wave to the rod diameter can be achieved on a finish stage by drying by supply of hot air and suction after molecules has moved sufficiently to a shape formed by the rod R in conditions in which the molecules inside the hair can move easily as compared to a case of not performing the steam treatment. The treatment after heating with steam is a process of stopping the supply of steam and after that drying the hair by suction by supplying hot air to the hair wound around the rod R like the first embodiment described above and thus, detailed description thereof is omitted.

Although according to the second embodiment, the steam generating unit 14 is installed outside the housing 3, it is preferable to incorporate the steam generating unit 14 in the housing 3 and supply steam into the hood F.

Third Embodiment

Next, the third embodiment will be described with reference to FIGS. 21 to 24.

According to the above-described embodiment, hot air at a predetermined temperature heated by the heater is supplied into the hood F and the hot air is sucked through the rod R with the interior of the rod R kept in a negative pressure by a circulation type blower 1 and air from the steam separator 2 is heated by a heater again and supplied back into the hood F so that the hair is dried by this circulation activity. However, there occurs such a problem that it takes time until the temperature of hot air is dropped if the hot air is hotter than a preliminarily set temperature.

Figure 21:
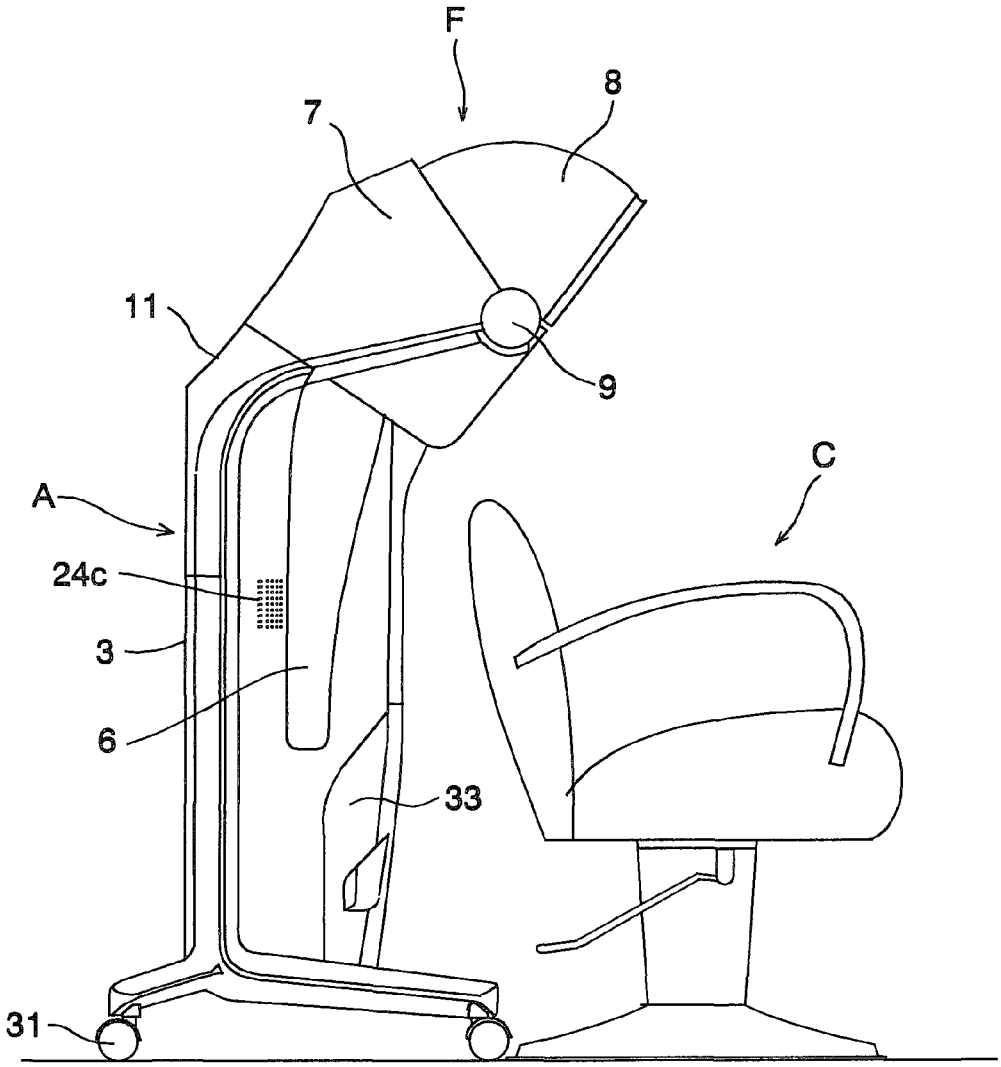
FIG. 21 is a side view of a permanent wave treatment apparatus of a third embodiment.
Figure 22:
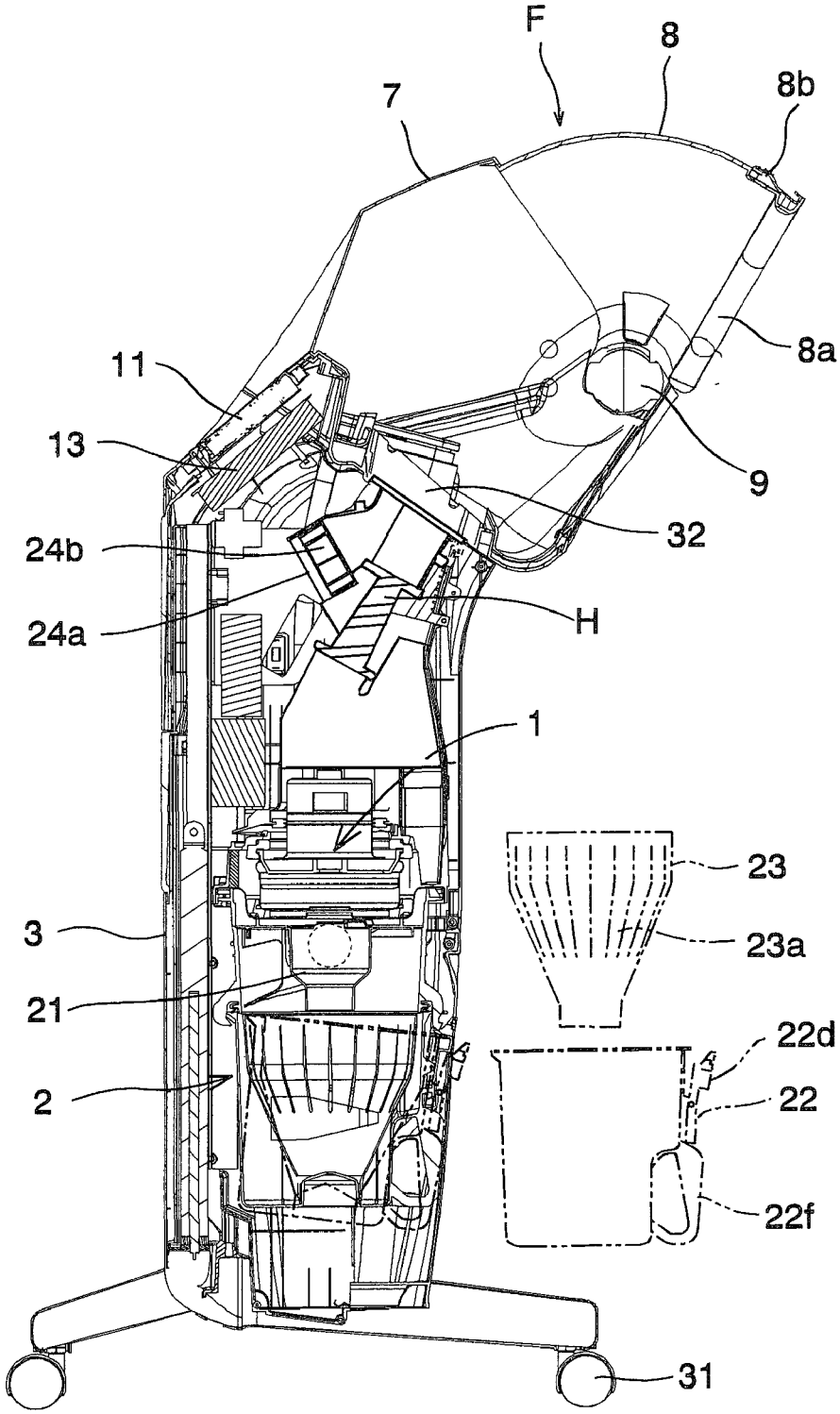
FIG. 22 is a side view of the third embodiment.

Thus, according to the third embodiment, if the temperature of the hot air rises over a temperature set preliminarily, outside air is introduced to secure a predetermined temperature. According to this embodiment, as shown in FIGS. 21, 22, outside air suction port 24*a* is provided near the outlet hole 32 of a pipe for spouting hot air from the outlet hole 32 and a fan 24*b* for sucking outside air is provided near the suction port 24*a* and an intake port 24*c* for outside air is formed at a position opposing the suction port 24*a* on the side face of the housing 3.

Figure 23:
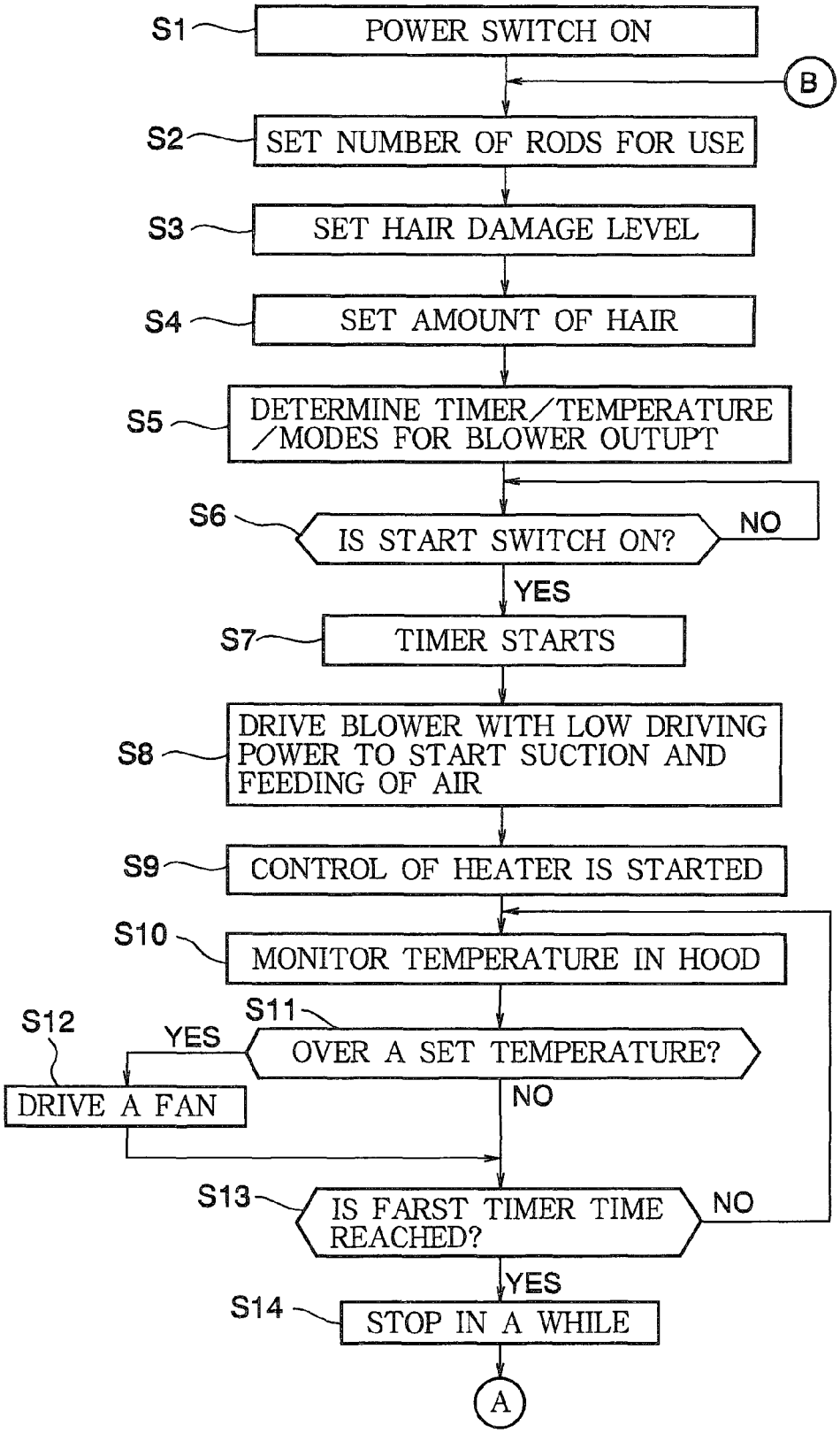
FIG. 23 is a flow chart showing the operation of the third embodiment.
Figure 24:
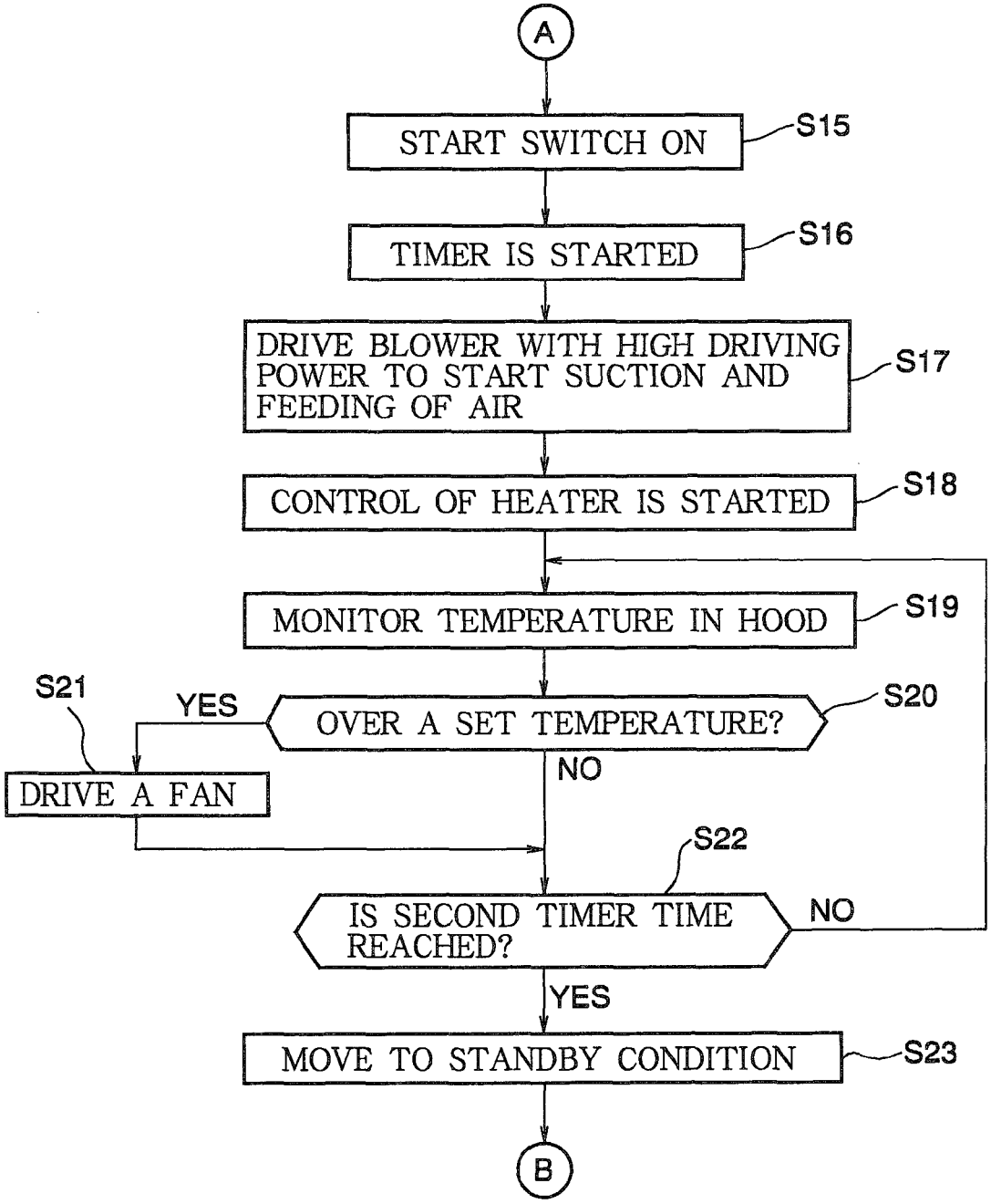
FIG. 24 is a flow chart showing continuation of the flow chart of FIG. 23.

Next, the operation of the control circuit 2 of this embodiment will be described with reference to the flow chart of FIGS. 23, 24.

First, the hair is wound around the rod R, the first permanent wave treatment agent containing reducing agent is applied to the wound hair and left for a predetermined amount of time so that the hair is swollen and softened. After the hair is swollen and softened, the first permanent wave treatment agent adhering to the hair is washed out and the washed hair is wiped with towel. After that, with the hood F of the permanent wave treatment apparatus of the present invention opened, an object person is seated in front of the treatment apparatus and the attachment device 41 is fitted to the rod R and the tube 4 is connected to the rod R. After a sealing member is fitted to the attachment device 41 which no rod R is connected to in order to prevent air leakage, the opened hood F is closed to cover the head of the object person while the face side is covered with the covering cloth 8*a* to seal the hood F. Although in the above description, a case where the tube 4 is connected to the rod R has been described, the tube 4 does not always need to be connected to the rod R. In this case, if no rod R is connected to the tube 4, the sealing member is fitted to its attachment device 41.

When a switch of a main power supply (not shown) is turned ON (step S1), the control circuit 13 is actuated. Then, the number of the rods Ron which the hair is wound is input by operating the rod number setting switch 112*c* (step S2). Next, a damage state of the hair is input by operating the damage setting switch 112*e* (step S3) and whether or not the amount of the hair wound around the rod is large is determined and the amount of the hair is input by operating the hair amount setting switch 112*d* (step S4).

After the three settings are ended, hair treatment time, environmental temperature to the hair and blower output intensity mode are picked up from data memorized in the ROM 13*d* to determine time and temperature (step S5) and then indicate them on the time indication portion 111*a* and temperature level indication portion 111*b*. With this condition, the CPU 13*a* monitors to see whether or not the start switch 112*f* is operated (step S6) and if it is determined that it is operated, time subtraction is started (step S7) and the blower 1 is actuated by low driving power to start feeding of hot air (step S8). When this air feeding is started, suction is carried out through the tube 4 and because the blower 1 is driven with low driving power, the hair wound around the rod R is maintained in hot wet condition (hot wet condition).

When the blower is driven in the step S8, the temperature sensor 12*b* installed in the hood F detects a temperature inside the hood F. Because the temperature in the hood when the start switch 112*f* is turned ON is as low as the room temperature, the heater control 13*f* is started (step S9). The heater control is started so that control of adjusting the interior of the hood F to a predetermined temperature (temperature determined by the ROM) is started (step S10). After the air feeding is started, the suction is carried out through the tube 4. Because the blower 1 is driven with low driving power, the hair wound around the rod R is maintained in wet condition.

Whether or not the temperature in the hood F rises over the set temperature due to some reason in this control condition is monitored by output from the temperature sensor 13*b* (step S11) and if it is determined that the temperature is over the set one, the fan 24*b* is driven to take outside air in and supply the air through the outlet hole 32. Consequently, hot air fed through the heater H is mixed so that a preliminarily set temperature is reached.

The CPU 13*a* monitors to see whether or not the set first time is reached (step S13) and if it is determined that the set time is not reached, the procedure is returned to step S10, in which the aforementioned control is carried out. If it is determined that the set time is reached, the driving of the blower 1 is stopped (step S14). In this stop condition, the practitioner check the hair condition by raising the hood F and if the tube 4 is not connected to the rod R, he or she connects the tube 4 to the rod R.

After the above-mentioned procedure is ended, the practitioner turns ON the start switch 112*f* (step S15) and then, the timer starts (step S16) while the blower 1 is started by high driving power (step S17) and at the same time, the control on the heater H is started (step S18). In this condition, the amount of air feeding is large and the suction force is strong because the blower 1 is driven by high driving power, so that the amount of hot air passing in the hair is large. Thus, drying of the hair is carried out rapidly. In the aforementioned drying condition, the temperature in the hood F is monitored (step S19) and whether or not the temperature is over a preliminarily set one is monitored (step S20). If it is determined that it is over the set one, the fan 24*b* is driven (step S21) to take outside air in and feed it through the outlet hole 32. Consequently, it is mixed with hot air supplied through the heater H so as to control the temperature to the set one.

Next, whether or not a second timer time is reached is monitored (step S22) and if it is determined that the set time is not reached, the procedure is returned to step S16, in which the aforementioned control is carried out. If it is determined that the second timer time is reached, standby condition is produced (step S23) and the procedure is returned to step S2, which waits for start of the permanent wave treatment for a next object person. In the above description, when the first timer time is passed, the driving of the blower 1 under low driving power is stopped and after that, the start switch 112*f* is turned ON to proceed to a next process. However, it is permissible to drive the blower 1 with high driving power after a preliminarily set time (time required for the practitioner to complete the aforementioned work) is elapsed after the blower 1 is stopped.

Next, the process of carrying out the permanent wave treatment using the permanent wave treatment apparatus of the third embodiment will be described.

First, with the first agent applied to the hair, steam is supplied from the steam generating unit 14 into the hood F so as to obtain a condition having high humidity and temperature and by combination with the driving of the blower 1 while heating the hair, steam is sucked slowly so that the hair wound around the rod R is reacted with the first chemical agent.

Next, the first agent adhering to the swollen hair is washed out or the action of the first agent is stopped with acidic intermediate treatment agent for neutralizing the first agent or after both the works are completed, the wet hair is left for a predetermined amount of time while heating. By heating with steam, the temperature of the hair can be raised with much water content contained in the hair. Consequently, molecules can move sufficiently into a shape deformed by the rod R in conditions in which molecules in the hair can move easily. Further; the amount of water content from the root of the hair to the tip thereof and the temperature can be equalized by sucking steam or mist with the interior of the rod kept in a negative pressure. By supplying hot air and drying the hair by suction, wave faithful to the rod diameter on finished stage can be formed. A subsequent process is a process of applying the second permanent wave treatment agent containing oxidizing agent to the dried hair and leaving it for a predetermined amount of time like the third embodiment. A detailed description thereof is omitted.

In this embodiment also, when the temperature sensor 13*b* detects that the temperature in the hood F exceeds a set value, the CPU 13*a* can suppress a rise of the temperature by taking in outside air by driving the fan 24*b*.

Although the steam generating unit 14 is installed outside the housing 3, it is preferable to accommodate the steam generating unit 4 within the housing 3 so as to supply steam into the hood F.

Next, the process of the permanent wave treatment method of the present invention will be described.

First, with the hair wound around the rod R, the first agent which is a reducing agent for the permanent wave treatment is applied to the hair and left until the chemical agent reacts with the hair so that it is swollen and softened. The first agent adhering to the swollen, softened hair is washed out or the action of the first agent is stopped with the acidic intermediate treatment agent for neutralizing the first agent or both the works are carried out. Then, the permanent wave treatment apparatus of the present invention is set to the head of the object person. At this time, introduction condition in which the second hood 8 overlaps the first hood 7 of the hood F shown in FIG. 14(*a*) is present.

After the object person is seated, as shown in FIG. 11(*b*), the second hood 8 is rotated up to a position in which it covers the head of the object person and at the same time, the first hood 7 is overlapped with the second hood 8 and the hoods are locked with the tightening member 9. As shown in FIGS. 1, 2, the entire head of the object person is covered with the first and second hoods 7, 8 in a spread condition. Consequently, the first and second hoods 7, 8 are locked with the stopper spring 8*b* of the second hood 8. Further, because a gap is generated between the head and the opening portion of the second hood 8, the object person's head from the forehead to the neck rear portion is covered with the covering cloth 8*a* and separated from outside.

Next, the control circuit 13 is turned ON by operating the start switch 112*f* and by operating the rod number setting switch 12*c*, the hair amount setting switch 12*d* and the damage setting switch 12*e* on the control panel 11, treatment time and treatment temperature are set up by the action of the control circuit 13. Consequently, the blower 1 is controlled to supply hot air of a set temperature so that the interior of the hood F turns into a constant temperature environment and in this condition, the hair is heated at a predetermined temperature (preferably below 60° C.) for a predetermined amount of time (which differs depending on the hardness, amount of the hair and the like). Further, high molecules come to move easily. In the meantime, heating of the hair is not limited to by hot air from the blower 1, but steam or mist may be used for heating as described in the second embodiment.

When the predetermined time is elapsed, the blower 1 is stopped temporarily so as to stop heating. After that, the hoods 7, 8 are opened and the tube 4 is extracted from the extraction member 5 and connected to the rod R on which the hair is wound. In the meantime, a cap is fitted to the attachment device 41 of the tube 4 to which no rod R is connected to block suction of air. If the tube 4 cannot be connected easily to the rod R on which the hair of the forehead of the object person is wound in the conditions of the first and second hoods 7, 8 as shown in FIG. 11(*b*), the hood F may be removed from the housing 3 for the connection work.

After the connection of the tube 4 to the rod R on which the hair is wound is ended, the entire head portion of the object person is covered with the first and second hoods 7, 8 in the spread condition and a gap between the head and the opening portion of the second hood 8 is covered with the covering cloth 8*a* and separated from outside.

When the practitioner turns ON the start switch 112*f*, the blower 1 is driven so that the interior of the tube 4 turns into a negative pressure and then, hot air heated in the hoods 7, 8 are sucked to dry the hair wound around the rod R quickly. Chemical agent and foreign matter contained in the sucked hot air are separated from air by the steam separator 2 and only hot air is sucked by the blower 1 and supplied to the hood F through the heater H. In the meantime, when the temperature sensor 13*b* detects that the temperature in the hood F exceeds a set one, the CPU 13*a* drives the fan 24*b* to take in outside air thereby suppressing a rise in temperature.

When the aforementioned drying process is ended, the second permanent wave treatment agent containing oxidizing agent is applied to the hair so as to achieve disulfide binding and the shape of the hair when dried is memorized. Then, after a predetermined time is elapsed, the hair is washed out, dried and styled and then, the work is ended.

The efficiency of a proposed treatment method will be described. The first agent adhering to the swollen, softened hair is washed out or the action of the first agent is stopped with the acidic intermediate treatment agent for neutralizing the first agent or both the works are carried out. After that, when the hair is heated after the both works are carried out and left for a predetermined amount of time, the second permanent wave treatment agent is applied to improve the wave treatment efficiency as compared to the conventional permanent wave treatment.

Figure 25A:
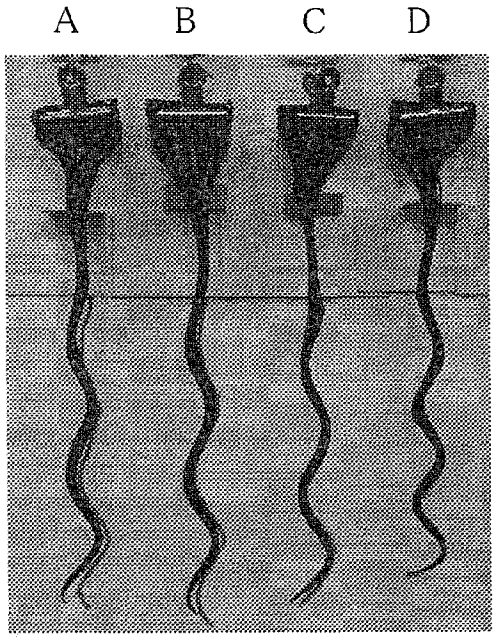
FIG. 25 shows photographs showing permanent wave treatment conducted according to the treatment of the present invention and the conventional treatment method, FIG. 25(*a*) is a photograph showing wet condition, FIG. 25(*b*) is a photograph showing dry condition and FIG. 25(*c*) is a photograph showing the condition of (b) with the hair direction changed.
Figure 25B:
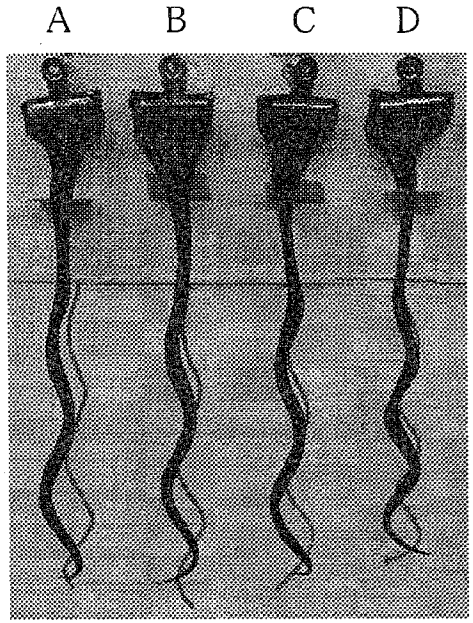
Figure 25C:
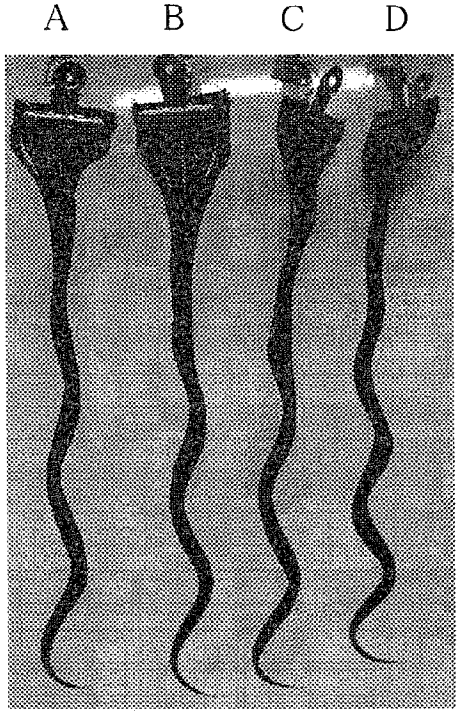
Figure 26:
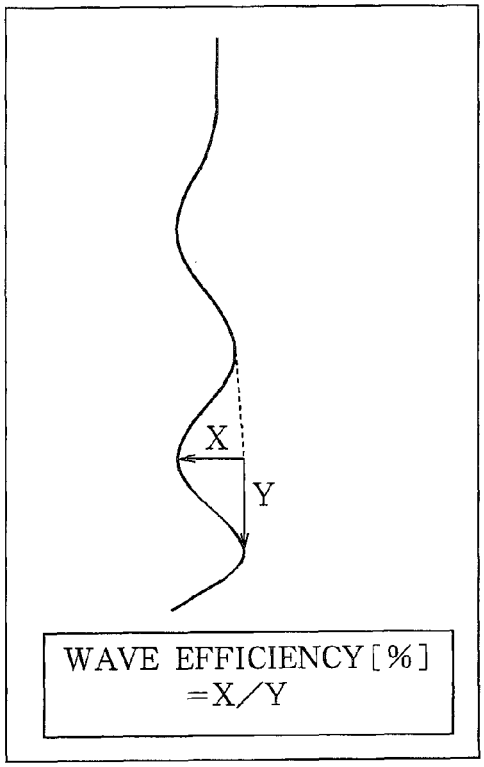
FIG. 26 is a diagram for explaining a calculation method for wave efficiency.

After the hair in the above stage is heated and left for a predetermined amount of time, the second agent containing oxidizing agent is applied to the dried hair in the drying process and when final styling for memorizing the shape in the dry condition is carried out, this dry condition maintains a wave shape like in the wet condition (slacking in the dry condition is small). Because in the hairs B, C, D in FIG. 25, the slacking of the wave in the wet condition and dry condition is smaller than a result of the hair A, its effect has been verified.

Because the hair C in an experiment carried out before application of the present invention is left under room temperature but not in heated condition when it is left for a predetermined amount of time before drying, its wave effect is more excellent than a result of the hair B not left for a predetermined amount of time before drying after the chemical agent is washed out and a difference between the effects is small.

However as for a result of the hair D obtained according to the treatment method of the present invention, heating treatment is carried out while maintaining the wet condition of the hair when it is left for a predetermined amount of time after the chemical agent is washed out and consequently, the wave efficiency has been improved largely, thereby indicating the best wave effect. This comparison result indicates a result of comparing the treatment methods when leaving for the predetermined amount of time after the hair is treated with the first agent in an equal treatment time and the chemical agent is washed out. As indicated in this result, the wave efficiency is improved more largely than in the conventional permanent treatment method and the treatment time with the first agent is reduced as compared with conventionally. After the chemical agent is washed out, the wet hair is heated and left for the predetermined amount of time, so that a structural change in the hair by the chemical agent is suppressed to a maximum extent thereby achieving the permanent wave which can attain a high wave efficiency.

Figure 27:
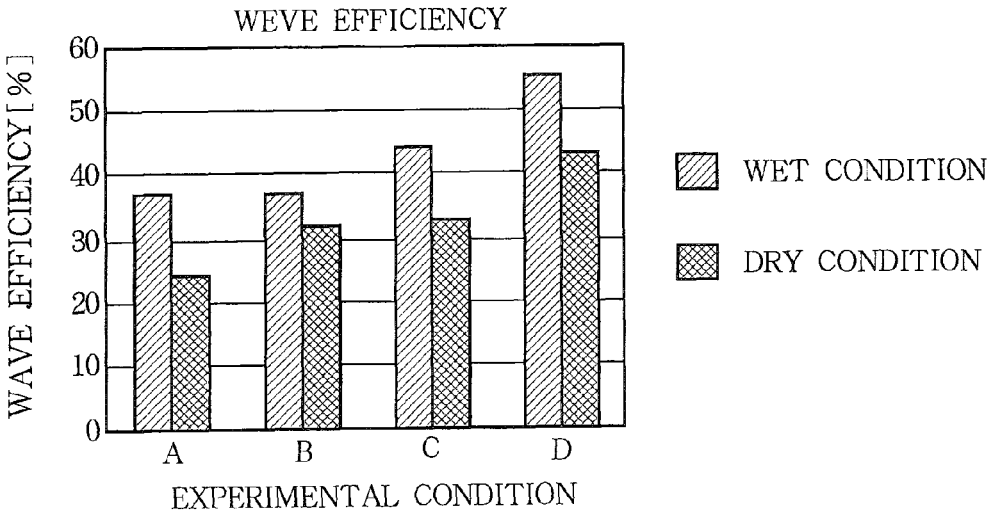
FIG. 27 is a graph showing a comparison result of wave efficiency.
Figure 28:
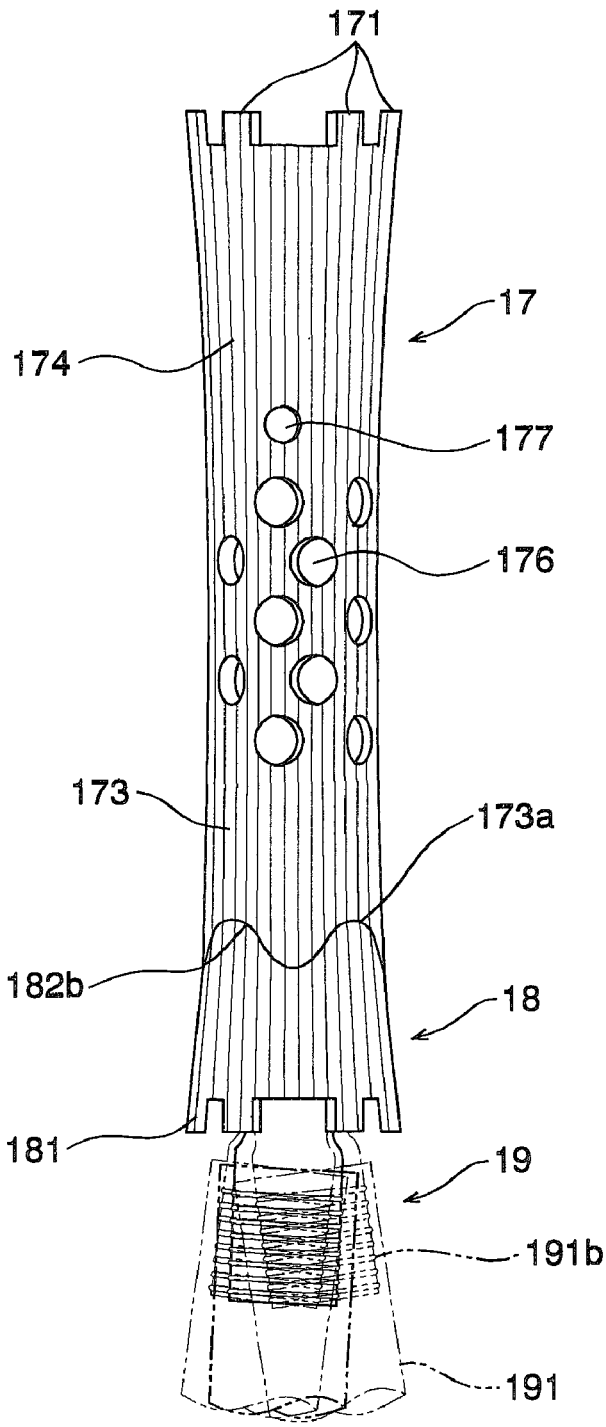
FIG. 28 is a front view showing a condition in which members of the rod are joined together.
Figure 29:
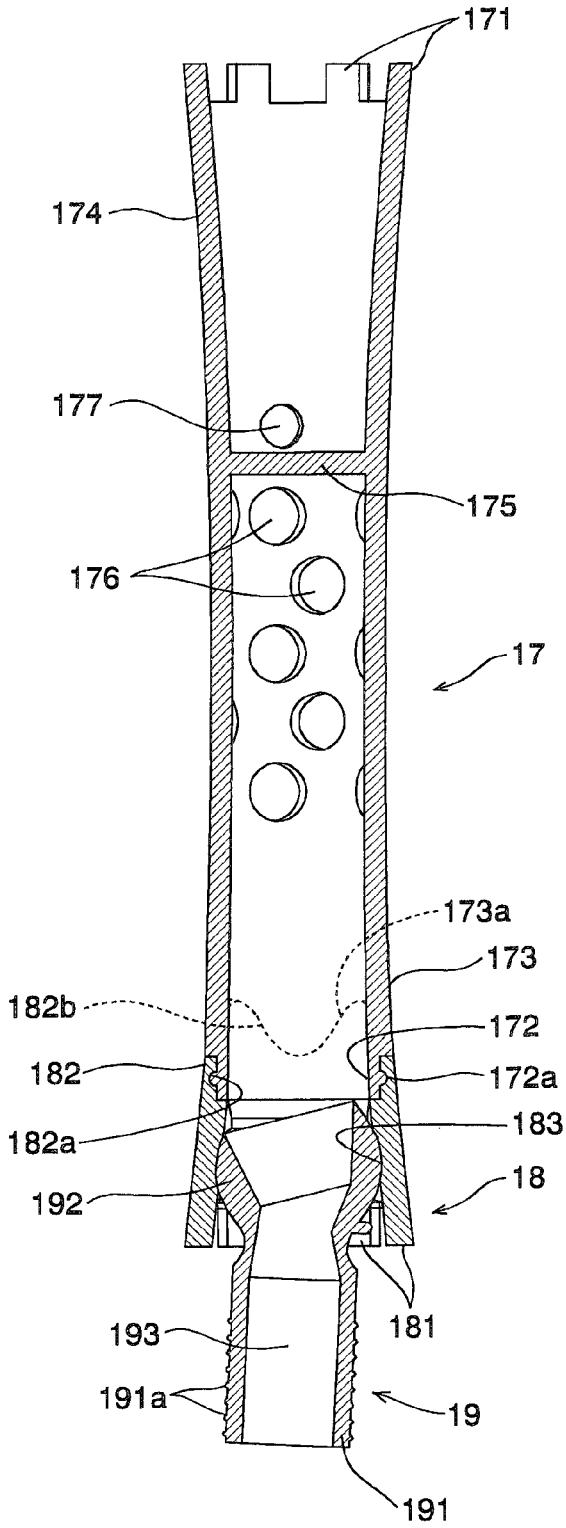
FIG. 29 is a sectional view of FIG. 29.
Figure 30:
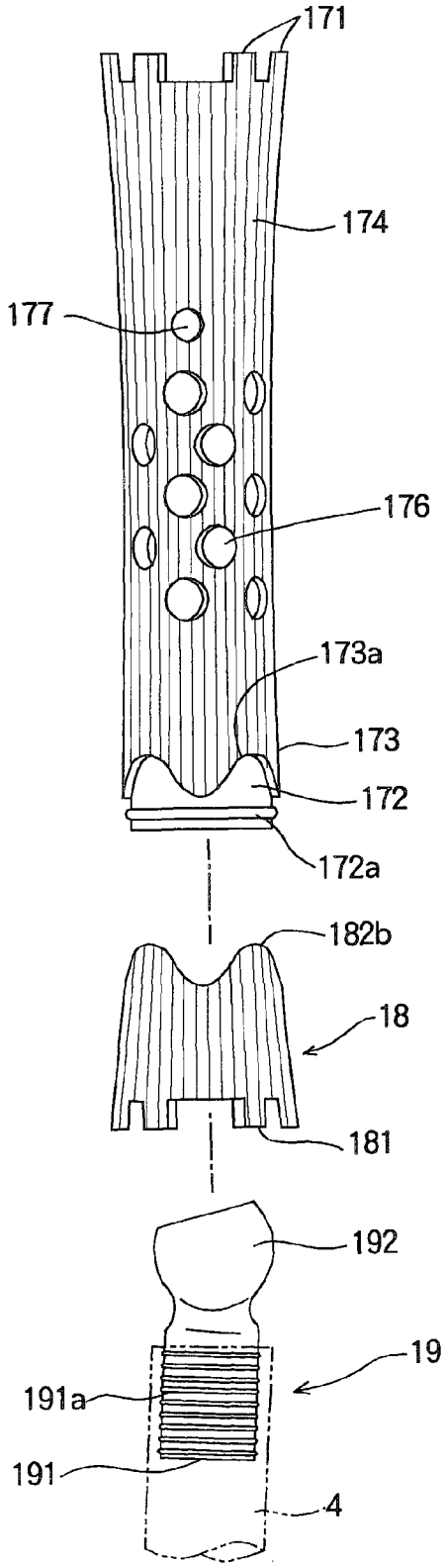
FIG. 30 is a front view of a condition in which three members of FIG. 28 are separated.
Figure 31:
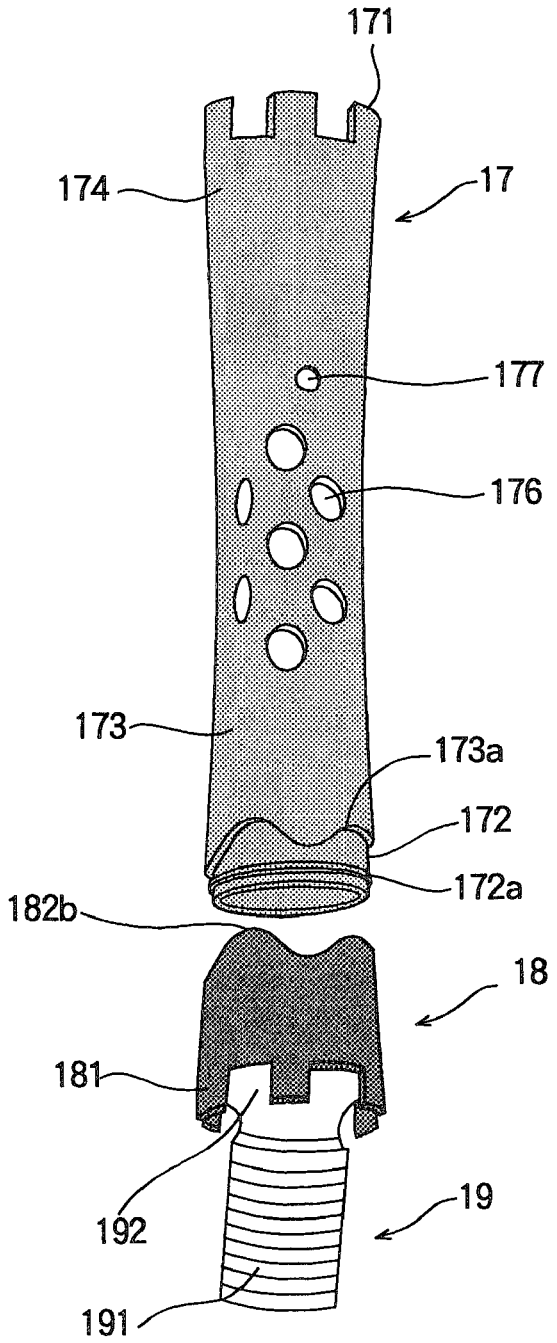
FIG. 31 is a front view of a case where the rod main body and closing member in FIG. 28 are colored in different colors.

Next, a calculation method of the wave will be described. As for the wet condition of the hair washed out after the second agent is applied, the wave efficiency was calculated using the wet condition of FIG. 25(*a*) and the dry condition in FIGS. 25(*b*), and (*c*). The calculation method of the wave efficiency is dividing a height X from the central portion of the wave up to the height by a length Y from the center of the wave to a next wave. Its result is shown in FIG. 27.

Figure 8:
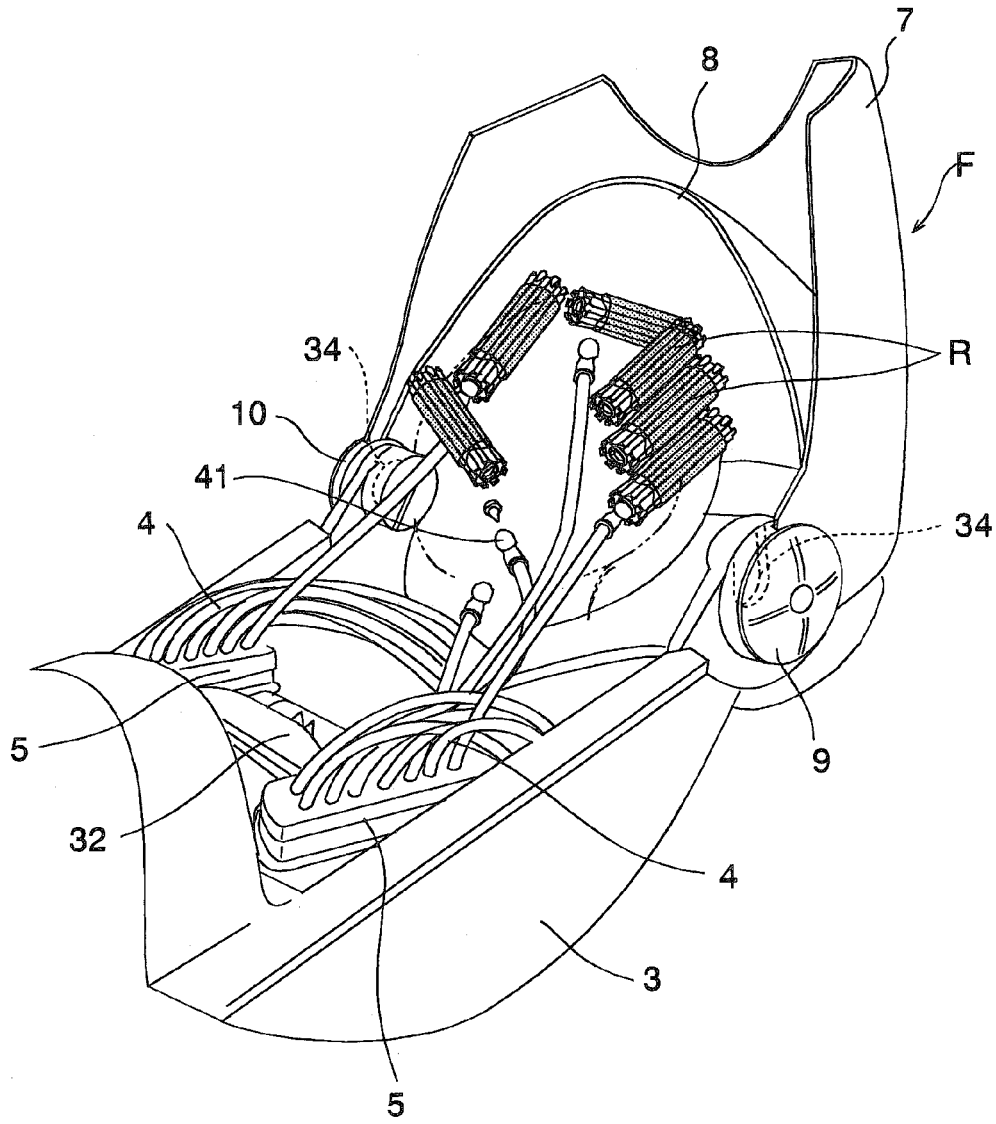
FIG. 8 is a perspective view of the embodiment with a hood opened.
Figure 9:
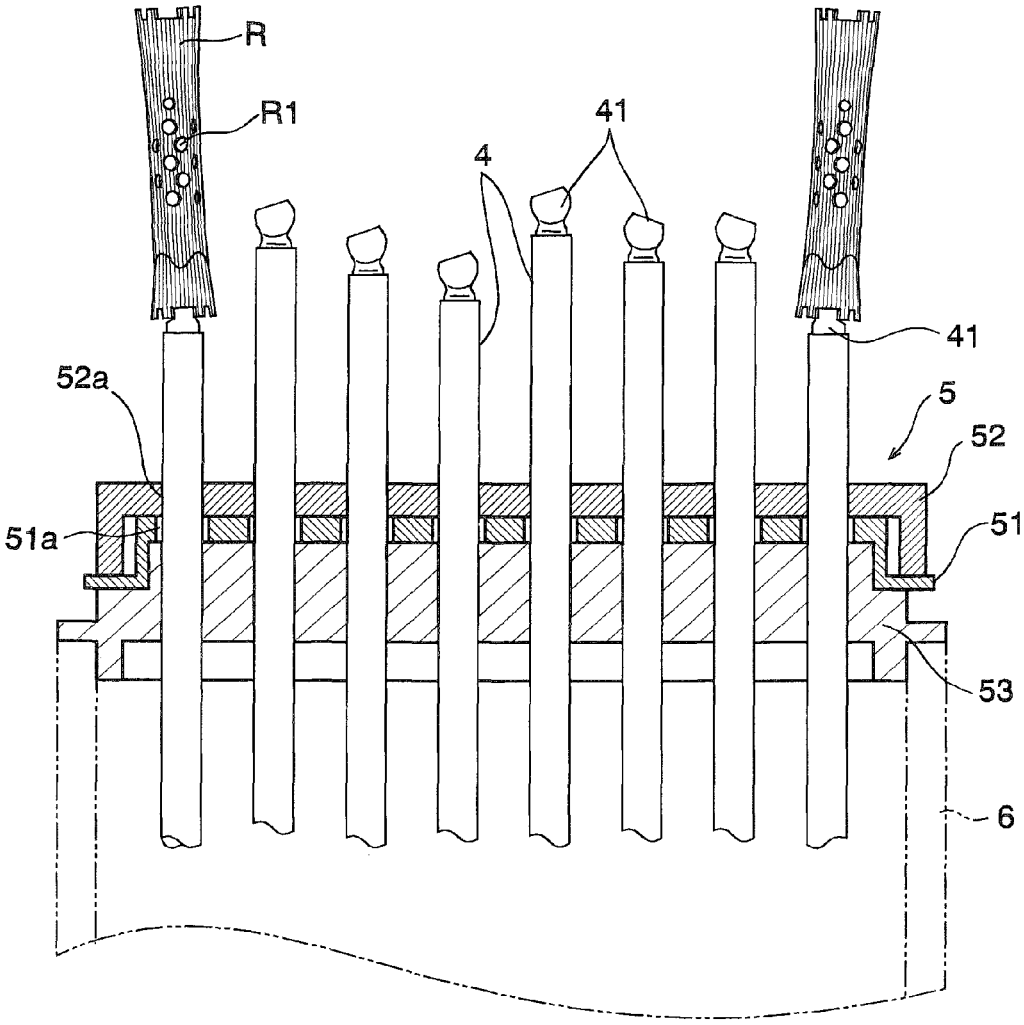
FIG. 9 is a sectional view of an extraction member showing a condition in which tubes can be extracted.
Figure 10:
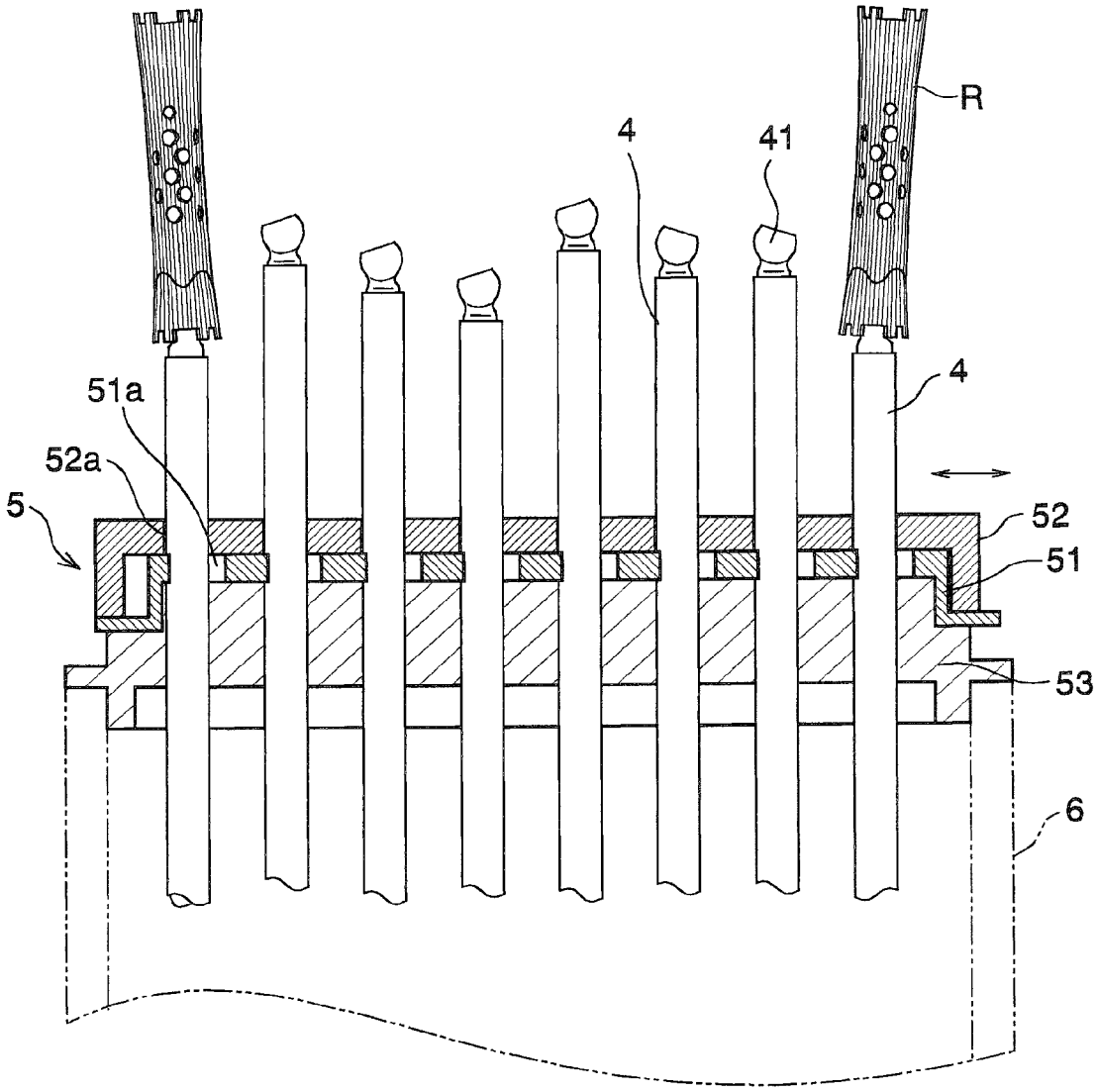
FIG. 10 is a sectional view of the extraction member showing a condition in which the tubes cannot be extracted.

Next, the detail of the rod R shown in FIGS. 8 to 10 in the above-described embodiment will be described with reference to FIGS. 28 to 31.

The rod R is comprised of a rod main body 17, a closing member 18 which is to be fitted to an opening at an end of the rod main body 17 detachably and an engaging member 19 which is attached detachably to the opening portion of the closing member 18 so that it is engaged rotatably. In the meantime, reference numeral 4 denotes a suction tube an end of which is connected to a suction device and the other end of which is fitted to the engaging member 3.

The detail of the respective members will be described. The rod main body 17 is formed of synthetic resin of relatively flexible material and constructed entirely in a cylindrical shape. A number of projecting portions 171 for fixing the rod main body 17 by hitching a rubber ring to concave/convex portions 181 of the closing member 18 so as to prevent the rod main body 17 from going off the hair are formed at an end of the cylinder. In the meantime, the rod main body 17 does not need always to be formed of flexible material.

The other end of the rod main body 17 is formed of a thin portion 172 and a thick portion 173 and a ring-like projection 172*a* is formed on the outer peripheral face of the thin portion 172 while a wave-like concave/convex portion 173*a* is provided on an end face of the thick portion 173. A number of hair slippage preventing grooves 174 are formed in the outer peripheral face along the length direction of the rod main body 17 and a partition wall 175 is formed inside the rod main body 17 on a position closer to the projecting portion 171.

A number of air vent holes 176 are formed in the peripheral face between the partition wall 175 and the end portion composed of the thin portion 172 and the thick portion 173 and a small hole 177 for preventing chemical agent from being collected inside is formed in the peripheral face between the partition wall 175 and the projecting portions 171. Although the air vent hole 176 is circular, it may be an elongated hole along the length direction.

If speaking of the detail of the closing member 18, the closing member 18 is formed of synthetic resin of flexible material and formed entirely in a short cylinder. Then, the convex portion 181 for hitching a rubber ring to the projecting portion 171 of the rod main body 17 is formed at an end of the cylinder.

The thin portion 182 is formed at the other end of the closing member 18 and a ring-like concave row 182*a* which engages the projection 172*a* formed on the thick portion 172 of the rod main body 17 is formed in the inner peripheral face of the thin portion 182. Further, a concave/convex portion 182*b* which coincides with the concave/convex portion 173*a* of the thick portion 173 of the rod main body 17 is formed on an end face. A circular engaging portion 193 which a ball portion 192 of the engaging member 19 engages rotatably is formed on the inner peripheral face at an intermediate portion of the closing member 18.

Next, if speaking of the detail of the engaging member 19, the engaging member 19 is formed of relatively hard synthetic resin and constituted of a cylindrical portion 191 and a semi-spherical ball portion 192. A communication hole 193 is formed in the cylindrical portion 191 and the ball portion 192 and a number of projections 191*a* are formed in the circumferential direction of the outer circumference of the cylindrical portion 191 so that the suction tube 4 is not pulled out easily.

Preferably, the rod main body 17 and the closing member 18 are formed of flexible synthetic resin and further synthetic resin of different colors. Although the engaging member 19 is formed of relatively hard synthetic resin, it may be colored in any color. Further, the opening portion of the ball portion 192 is open such that it is inclined with respect to the axis and consequently, the swing angle of the engaging member 19 is increased to prevent reduction of suction force.

When winding the hair around the rod R having such a structure, the closing member 18 is kept in contact with the rod main body 17. At this time, the connecting direction of the engaging member 19 can be seen easily when the hair is wound around the rod because the colors of the rod main body 17 and the closing member 18 are different. Consequently, the engaging member 19 can be mounted to the closing member 18 easily. Further, the size of the rod main body 17 can be known from the color thereof when the hair is wound by changing the colors of the closing member 18 for each size of the rod main body 17, thereby facilitating winding of the hair around the rod main body 17 of each size.

Because the rod main body 17 and the closing member 8 are bound through the concave/convex portions 173*a*, 182*b*, the closing member 18 is never rotated with respect to the rod main body 17, thereby causing no trouble in hair winding procedure and further, the hair never invades in a connecting portion between the rod main body 17 and the closing member 18.

After winding the hair around the rod main body 17 according to the shape of permanent wave is finished, the rod R is fixed to the hair by hitching a rubber ring between the projecting portion 171 of the rod main body 17 and the concave/convex portion 181 of the closing member 18. Next, the ball portion 192 of the engaging member 19 in which the suction tube 4 is attached to the cylindrical portion 191 is pressed into the engaging portion 183 of the closing member 18 by inserting in an oblique direction and engaged therewith. Even when the engaging member 19 is slanted for this press-in procedure, the closing member 18 is deformed when the engaging member 19 makes contact with the concave/convex portion 181 of the closing member 18 because the closing member has plasticity, thereby facilitating the press-in procedure.

As a result of this structure, if fluid like permanent wave treatment chemical agent flows into the closing member 8 through the air vent hole 176 in the rod main body 17 when the rod main body 17 is sucked by the suction means with the wound hair heated, it flows into the engaging member 19 from the opening portion of the ball portion 192 and this flowing fluid is sucked into the engaging member 19 due to its suction force, so that it flows into the steam separating means 2 together with air. Then, air and fluid are separated by this steam separating means 2 and fluid is discharged later.

Figure 32:
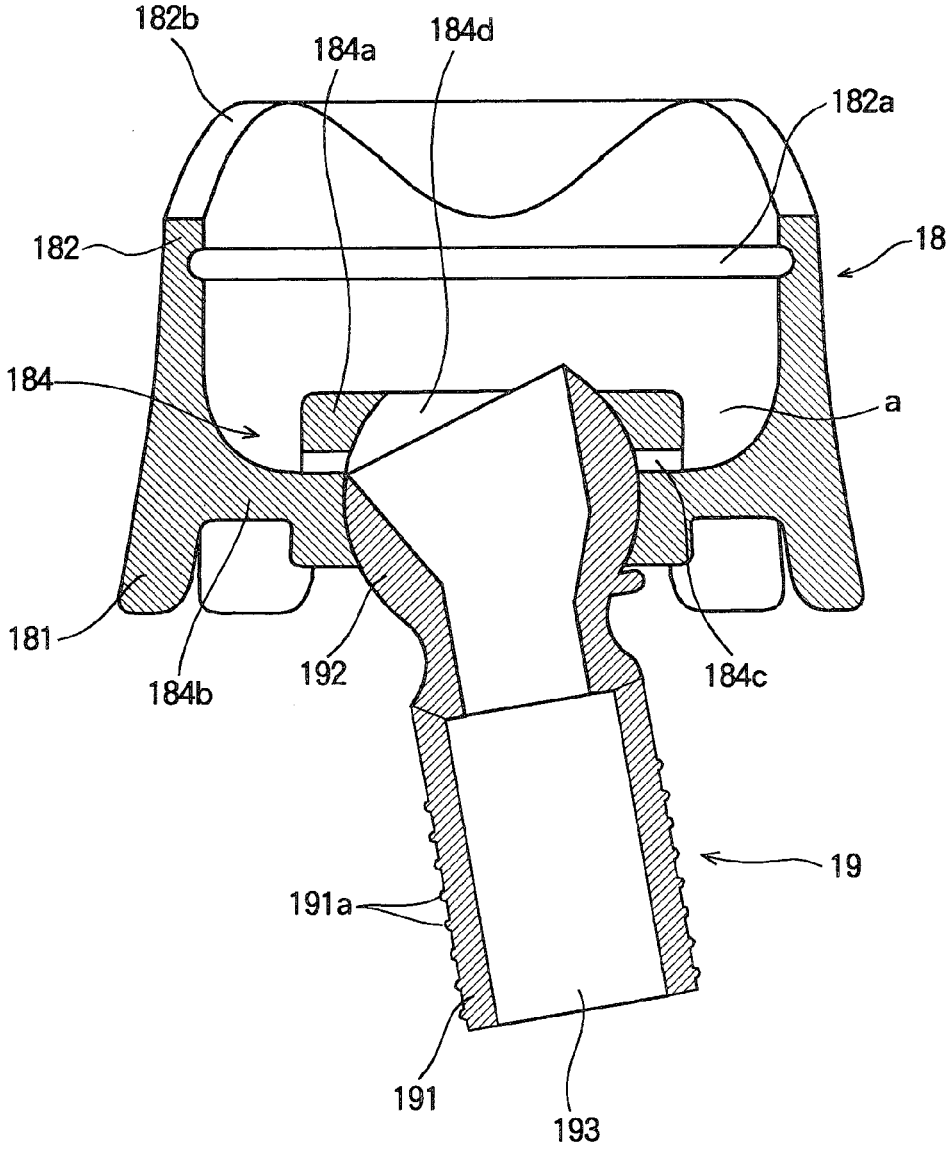
FIG. 32 is a sectional view of a condition in which an engaging member is coupled with a closing member of other embodiment.

FIG. 32 shows other embodiment and the rod main body 17 of this embodiment has a diameter larger than the rod main body 17 described before and is used to produce a larger curl in the hair when it is subjected to the permanent wave treatment. The engaging member 19 for use in the embodiment described before cannot be used for such a large rod. In the above embodiment, a curved concave portion which is the engaging portion 183 which is to engage the ball portion 192 of the engaging member 19 is formed in the inner peripheral face of the closing member 18. If the diameter of the rod main body 17 is large, the diameter of the closing member 18 is also large and if the engaging portion 183 is formed directly on the inner peripheral face of the closing member 18, it cannot engage the ball portion 192 of the engaging member 19.

In this embodiment, in order to form the ball portion 192, the thickness of a central portion 184*a* inside the closing member 18 is increased and the thickness of an outer peripheral portion 184*b* is decreased so as to form a lid portion 184 for constituting a sump a for the fluid flowing from the air vent hole 176 in the rod main body 17. A circular engaging portion 184*d* for engaging the ball portion 192 for use in the above embodiment rotatably is open in the thick portion. Further, a communication hole 184*c* which allows fluid like the permanent wave treatment chemical agent collected in the sum a to flow out is formed on the border between the thick portion and the thin portion. The structure of the rod main body 17 is enlarged in diameter and the structure of the engaging member 19 is the same as the above-described embodiment. The colors of the closing member 18 and the rod main body 17 are also different. Description of these matters is omitted.

With such a structure, if the rod main body 17 is sucked by the suction means with the wound hair heated, fluid like the permanent wave treatment chemical agent collected on the sump a in the closing member 18 from the air vent hole 176 in the rod main body 17 flows into the engaging portion 184*d* through the communication hole 184*c*. Consequently, it flows into the engaging member 19 from an opening portion in the ball portion 192 and the fluid flowing in is sucked into the engaging member 19 by suction force, so that it flows into the steam separating means 2 together with air. Then, air and fluid are separated by this steam separating means 2 and the fluid is discharged out later.

The invention claimed is:

1. A permanent wave treatment apparatus comprising: a housing;

a blower which is installed within the housing to suck air and blow air to supply heated air;

a steam separator which is provided on the blower to remove water content from said heated air sucked by suction force of the blower;

an outlet hole formed in the housing through which air is spouted from the blower;

tubes to keep an interior thereof in a negative pressure by the suction force of the blower; and a plurality of rods, each having a generally cylindrical side wall extending between first and second ends, which are rotatably attached to the respective ends of the tubes, on which the hair of an object person is to be wound and in which air circulation holes are formed in said substantially cylindrical side wall to allow the heated air to pass through the hair of the object person by way of said negative pressure in the tubes;

hoods mounted on the housing and including a first hood and a second hood tightened by tightening members to rotate about a vertex portion thereof relative to said housing such that they are capable of being overlapped with each other such as to be opened/closed freely, said first hood and said second hood being adapted to cover a rear head side and a forehead side of the object person; and an extraction member which holds said plurality of tubes such as to be extracted freely.

2. A permanent wave treatment apparatus comprising: a housing;

a blower which is installed within the housing to suck air and blow air to supply heated air;

a steam separator which is provided on the blower to remove water content from said heated air sucked by suction force of the blower;

an outlet hole formed in the housing through which air is spouted from the blower;

tubes to keep an interior thereof in a negative pressure by the suction force of the blower; and a plurality of rods, having a generally cylindrical side wall extending between first and second ends, which are rotatably attached to the respective ends of the tubes, on which the hair of an object person is to be wound and in which air circulation holes are formed in said substantially cylindrical side wall to allow the heated air to pass through the hair of the object person by way of said negative pressure in the tubes;

hoods mounted on the housing and including a first hood and a second hood tightened by tightening members to rotate about a vertex portion thereof relative to said housing such that they are capable of being overlapped with each other such as to be opened/closed freely, said first hood and the second hood being adapted to cover the rear head side and the forehead side of the object person; and a steam generating unit provided outside or inside the housing to supply steam into the hood;

an extraction member which holds said plurality of tubes such as to be extracted freely.

3. The permanent wave treatment apparatus according to claim 1 or 2 wherein the extraction members are disposed on both sides of the outlet hole and constructed to be capable of locking an extracted condition of the tube.

4. The permanent wave treatment apparatus according to claim 1 or 2 wherein the steam separator includes a vortex generating unit installed on the bottom of the blower; a separating unit through which fluid contained in the air formed into a vortex by the vortex generating unit passes via slit; and a cup in which the fluid separated from the separating unit is collected.

5. The permanent wave treatment apparatus according to claim 1 or 2 wherein a portion of the tube opposite to a side connected to a rod is inserted into a suction pipe one end of which is connected to the vortex generating unit of the steam separator in air-tight condition while the other end is connected to the extraction member in air-tight condition and when the interior of the suction pipe turns into a negative pressure by the blower, the interior of the tube turns into a negative pressure.

6. The permanent wave treatment apparatus according to claim 2 wherein when steam is supplied into the hood by the steam generating unit, supply and suction of air are carried out by the blower.

7. The permanent wave treatment apparatus according to claim 1 or 2 wherein an outside air introducing unit which sucks outside air with a fan to introduce the outside air into the hood is provided within the housing.

8. The permanent wave treatment apparatus according to claim 7 wherein the opening portion for introducing air into the hood of the outside air introducing unit is open to the outlet hole which supplies hot air from the blower into the hood.

9. The permanent wave treatment apparatus according to claim 7 wherein the fan of the outside air introducing unit is driven when the temperature sensor detects that the temperature in the hood exceeds the predetermined temperature.

10. The permanent wave treatment apparatus according to claim 1 or claim 2 wherein one of a shaft supporting member which support the first hood and the second hood is a tightening member capable of being tightened and fixed at a desired angle in a relative angle between the first hood and the second hood.

11. The permanent wave treatment apparatus according to claim 1 or 2 wherein one of a shaft supporting member which supports the first hood and the second hood is a locking member which is locked when the second hood is located at a treatment angle position in order to prevent the second hood from rotating toward the face side of an object person.

12. The permanent wave treatment apparatus according to claim 1 or 2 wherein the shaft supporting member which supports the first hood and the second hood is provided detachably on the housing.

13. The permanent wave treatment apparatus according to claim 1 or 2 wherein in a treatment condition in which the amount of overlapping between the first hood and the second hood is reduced, area of object person's head from the forehead to the rear head is covered with covering cloth attached to an opening portion of the second hood so as to prevent hot air supplied from the permanent wave treatment apparatus from leaking out.

14. The permanent wave treatment apparatus according to claim 1 or 2 wherein the rod is constituted of a rod main body formed into a cylindrical shape in which a partition wall is formed inside while a plurality of air vent holes are formed in the outer peripheral face on a side whose length from the partition wall to an end thereof is larger; and a closing member which is attached detachably to an end portion of the rod main body on a side having the air vent holes and has an engaging portion which rotatably engages an engaging member connected to the suction means.

15. The permanent wave treatment apparatus according to claim 1 or 2 wherein the rod is constituted of a rod main body formed into a cylindrical shape in which a partition wall is formed inside while a plurality of air vent holes are formed in the outer peripheral face on a side whose length from the partition wall to an end thereof is larger;

and a closing member which is attached detachably to an end portion of the rod main body on a side having the air vent holes, in which a lid portion is formed such that the thickness of a central portion inside is increased while the thickness of an outer peripheral portion is decreased so as to constitute a sump for fluid flowing from the air vent holes; an engaging portion which rotatably engages an engaging member connected to a suction means is open in the thick portion; and a communication hole which allows fluid from the sump to flow into the engaging portion is formed.

16. The permanent wave treatment apparatus according to claim 1 or 2 wherein said first and second hoods are configured to independently move in order to expose a rear portions of an object person's head in a first state in which one of said hoods is in a first open position and to expose a front portion of the object person's head in a second state in which the other of said hoods is in a second open position.

17. The permanent wave treatment apparatus according to claim 1 or 2 wherein said extraction member is configured to allow said tubes to be extended to adjust the positions of said tubes when said hoods are in an open state exposing said tubes.

18. The permanent wave treatment apparatus according to claim 1 or 2 wherein said tubes are each connected at intake ends to one of said ends of each of the rods and each communicate from discharge ends to said steam separator so as to keep the interior of the rods in a negative pressure by the suction force of the blower.

* * * * *